US007220705B2

(12) United States Patent
Hare

(10) Patent No.: US 7,220,705 B2
(45) Date of Patent: May 22, 2007

(54) SUBLIMINATION DYE THERMAL TRANSFER PAPER AND TRANSFER METHOD

(75) Inventor: Donald S. Hare, Hawley, PA (US)

(73) Assignee: Foto-Wear, Inc., Olyphant, PA (US)

( * ) Notice: Subject to any disclaimer, the term of this patent is extended or adjusted under 35 U.S.C. 154(b) by 0 days.

(21) Appl. No.: 10/483,387

(22) PCT Filed: Jul. 12, 2002

(86) PCT No.: PCT/US02/21822

§ 371 (c)(1),
(2), (4) Date: Apr. 1, 2004

(87) PCT Pub. No.: WO03/006736

PCT Pub. Date: Jan. 23, 2003

(65) Prior Publication Data

US 2004/0157735 A1 Aug. 12, 2004

Related U.S. Application Data

(60) Provisional application No. 60/304,752, filed on Jul. 13, 2001.

(51) Int. Cl.
*B41M 5/35* (2006.01)
*B41M 5/38* (2006.01)

(52) U.S. Cl. ..... 503/227; 8/471

(58) Field of Classification Search ..... 8/471; 503/227

See application file for complete search history.

(56) References Cited

U.S. PATENT DOCUMENTS

| | | | |
|---|---|---|---|
| 3,222,419 | A | 12/1965 | Jubilee et al. |
| 3,257,478 | A | 6/1966 | Jubilee et al. |
| 3,658,570 | A | 4/1972 | Crooks et al. |
| 3,936,542 | A | 2/1976 | Cox |
| 4,021,591 | A | 5/1977 | DeVries et al. |
| 4,189,395 | A | 2/1980 | Bland |
| 4,235,657 | A | 11/1980 | Greenman et al. |
| 4,284,456 | A | 8/1981 | Hare |
| 4,322,467 | A | 3/1982 | Heimbach et al. |
| 4,337,289 | A | 6/1982 | Reed et al. |
| 4,351,871 | A | 9/1982 | Lewis et al. |
| 4,477,622 | A | 10/1984 | Sanderson et al. |
| 4,486,033 | A | 12/1984 | Parrotta |
| 4,555,436 | A | 11/1985 | Geurtsen et al. |
| 4,726,979 | A | 2/1988 | Chapman |
| 4,773,953 | A | 9/1988 | Hare |
| 4,863,781 | A | 9/1989 | Kronzer |
| 4,869,957 | A | 9/1989 | Vankerckhoven et al. |
| 4,966,815 | A | 10/1990 | Hare |
| 4,980,224 | A | 12/1990 | Hare |
| 5,006,502 | A | 4/1991 | Fujimura et al. |
| 5,019,475 | A | 5/1991 | Higashiyama et al. |
| 5,104,719 | A | 4/1992 | Kamen et al. |
| 5,139,917 | A | 8/1992 | Hare |
| 5,163,247 | A | 11/1992 | Weber et al. |
| 5,236,801 | A | 8/1993 | Hare |
| 5,242,739 | A | 9/1993 | Kronzer et al. |
| 5,242,781 | A | 9/1993 | Ohbayashi et al. |
| 5,271,990 | A | 12/1993 | Kronzer et al. |
| 5,318,943 | A | 6/1994 | Ueno et al. |
| 5,366,837 | A | 11/1994 | Sakai |
| 5,370,132 | A | 12/1994 | Weber et al. |
| 5,441,056 | A | 8/1995 | Weber et al. |
| 5,501,902 | A | 3/1996 | Kronzer |
| 5,603,996 | A | 2/1997 | Overcash et al. |
| 5,612,168 | A | 3/1997 | Ishikawa |
| 5,620,548 | A | 4/1997 | Hare |
| 5,665,479 | A | 9/1997 | Vandamme et al. |
| 5,678,247 | A | 10/1997 | Vickers |
| 5,741,387 | A | 4/1998 | Coleman |
| 5,741,754 | A | 4/1998 | Moto et al. |
| 5,759,738 | A | 6/1998 | Tsuno et al. |
| 5,798,179 | A | 8/1998 | Kronzer |
| 5,882,388 | A | 3/1999 | Adair et al. |
| 5,925,712 | A | 7/1999 | Kronzer |
| 5,948,586 | A | 9/1999 | Hare |
| 6,033,824 | A | 3/2000 | Hare et al. |
| 6,228,543 | B1 | 5/2001 | Mizuno et al. |
| 6,358,660 | B1 | 3/2002 | Agler et al. |
| 6,410,200 | B1 | 6/2002 | Williams et al. |

FOREIGN PATENT DOCUMENTS

| | | | |
|---|---|---|---|
| DE | 4432383 | C | 11/1995 |
| EA | 0842787 | | 5/1998 |
| EP | 0728801 | A2 | 8/1996 |
| EP | 0820874 | A | 1/1998 |
| FR | FR-2442721 | | 6/1980 |
| GB | 2202641 | A | 9/1988 |
| WO | WO-9321561 | | 10/1993 |
| WO | WO-18090 | A | 5/1997 |
| WO | WO 97/33763 | A2 | 9/1997 |
| WO | WO-20393 | A | 5/1998 |
| WO | WO-21398 | A | 5/1998 |

*Primary Examiner*—Bruce H. Hess
(74) *Attorney, Agent, or Firm*—Birch, Stewart, Kolasch & Birch, LLP

(57) ABSTRACT

An image transfer sheet is provided which comprises a support, a barrier layer, a polyester layer and an optional a sublimation dye receiving layer; wherein the polyester is capable of being physically separated by the user without water, chemicals or heat. The peeled and imaged polyester is placed onto a receptor element and a non-stick sheet is optionally placed thereon. An iron is placed onto the optional non-stick sheet to drive the polyester and image into the receptor. The invention allows for both correct order image-wise printing and reverse order image-wise printing. This invention allows sublimation dye printing onto a cotton receptor.

21 Claims, No Drawings

SUBLIMINATION DYE THERMAL TRANSFER PAPER AND TRANSFER METHOD

This application claims the benefit of Provisional Application No. 60/304,752 filed Jul. 13, 2001.

BACKGROUND OF THE INVENTION

1. Field of the Invention

The present invention relates to an image transfer sheet containing a support, a barrier layer, a polyester layer, and an optional sublimation based colorant (i.e. dyes, ink, toners, etc.; hereinafter "sublimation dye") receiving layer and, and methods for transferring an image to a receptor element using the image transfer sheet. More specifically, the present invention relates to an image transfer sheet which can be applied to a receptor element, such as cotton or cotton/polyester blend fabrics or the like (e.g. wood, nylon, ceramics, etc.).

2. Description of the Prior Art

Textiles such as shirts (e.g., tee shirts) having a variety of designs thereon have become very popular in recent years. One technique used for decorating various textiles has been the sublimation dye printing technique. In sublimation printing, a design is printed on a paper backing sheet by conventional printing techniques using sublimation dyes, and then the design is transferred to a substrate under heat and pressure. Sublimation dye printing generally results in colors which stay bright during the heat transfer process.

Prior attempts to use sublimation dye in transfer designs to be applied to 100% cotton or high content cotton (i.e. 50% or more cotton) in cotton/polyester blend fabrics have resulted in distorted and faded colors. Attempts to overcome this problem have included two-step processes wherein the fabric to be printed is pretreated with an emulsion which would be more receptive to sublimation dyes. The printed image is then transferred to the treated fabric. The two-step process prevents the average consumer from using sublimation colorant printing techniques, since commercial facilities are required for the pre-treating and transferring steps.

PCT/US00/29796 relates to an image transfer sheet containing a support, a barrier layer, a sublimation dye layer and a polyester layer, and a method for transferring an image to a receptor element using the image transfer sheet. More specifically, it relates to an image transfer sheet which can be applied to a receptor element, such as cotton or cotton/polyester blend fabrics or the like.

U.S. Pat. No. 4,021,591 is directed to a dry release sublimation transfer element and to a method for decorating a substrate using the transfer element. The sublimation design layer has a thickness in the range of 0.1 to 3 mils.

U.S. Pat. No. 4,555,436 is directed to a heat transferable laminate comprising a support layer, a transfer layer, an ink design layer and an adhesive. The ink design layer is composed of conventional inks.

U.S. Pat. No. 4,657,557 relates to sublimation transfer sheets consisting of a base coated with a sublimation ink, further coated with a heat-resistant resin. A barrier layer is not employed in the sheets.

U.S. Pat. No. 4,914,079 is directed to a thermal transfer ink medium containing a support, an ink layer and an ink transfer layer. A barrier layer is not incorporated into the medium.

U.S. Pat. No. 4,927,709 is directed to a heat transferable laminate comprising a support layer, a transfer layer, an ink design layer and an adhesive. The ink design layer is composed of conventional inks.

U.S. Pat. No. 4,935,300 is directed to a heat transferable laminate comprising a support layer, a transfer layer, an ink design layer and an adhesive. The ink design layer is composed of conventional inks.

U.S. Pat. No. 5,322,833 relates to a dye-donor element for use in thermal sublimation dye transfers.

U.S. Pat. No. 5,413,841 is directed to heat activated transfer elements comprising a lower adhesive layer and an upper thermoset layer which contains an indicia layer formed from sublimation dyes. The thermosetting layers do not comprise thermally activated polymers.

U.S. Pat. No. 5,679,461 relates to thermally sensitive transfer recording materials comprising a base sheet, an ink layer and an ink-resistant lubricating layer. A barrier layer is not present between the ink layer and the lubricating layer.

U.S. Pat. No. 5,741,387 is directed to a lithographic printing process and transfer sheet comprising a backing sheet, a heat release layer, an ink design layer, a polymer layer and a lacquer mask layer. The ink design layer is composed of conventional inks which are described as being heat-resistant.

U.S. Pat. No. 6,143,454 relates to a color thermal transfer sublimation dye toner comprising at least a binder resin and a sublimation dye component, the binder resin comprising a high molecular weight polymer having a molecular weight of above about 100,000, and the sublimation colorant comprising a dye which sublimes at elevated temperatures above about 100° C.

When matter directly changes state from a highly organized solid state to an unorganized gas state, without going through the semi-ordered liquid state, such a change of state is referred to as sublimation. Whether matter sublimates depends on the chemical properties of the matter, and more importantly, on both the pressure and temperature of the system. Some materials have the property of being able to undergo sublimation under atmospheric pressure and elevated temperatures. Dry ice, or solid carbon dioxide, is one such material that undergoes sublimation at atmospheric pressure and room temperature. For dry ice, room temperature is said to be above the sublimation temperature of solid carbon dioxide at atmospheric pressure. As the temperature is raised above the sublimation temperature, the material undergoes a direct solid to gas phase transition since the material is given sufficient thermal energy to break intermolecular attractions operative in a liquid state. Not all matter exhibits this property. In contrast, water is a form of matter that when heated under atmospheric pressure conditions, has chemical properties consistent with solid to liquid to gas phase transitions. Solid water (ice) may also sublimate, but only at pressures far below atmospheric pressure.

Another class of material that exhibit both sublimation properties and color are known as sublimation colorants or dyes. Sublimation dyes, like dry ice, have chemical properties such that, when heated under near-atmospheric conditions, they sublimate or undergo a direct solid to gas phase transition. The sublimation temperature for a number of these dyes resides anywhere from just above room temperature to as high as the chemical decomposition temperature for organic systems such as 400° C. The important property that makes these colorants useful in printing applications is that, at these temperatures, sublimation dyes sublime under near atmospheric pressure conditions.

These sublimation colorants are used in a variety of ink formulations each targeted for a specific printing method.

They are typically found as the colorant in offset or lithographic ink mixtures. However, these colorants have also been mixed into formulations used for the newer electronic printing methods. The largest market for sublimation dyes is found in thermal ribbon printing for label and point-of-sale applications. With thermal printing, the sublimation colorant is dispersed into a wax or polyester binder formulation and coated onto a polyester or cloth ribbon. A mark is made on the receptor substrate by heating the back of the ribbon with a metal stylus and subliming the dye off the ribbon onto the receptor. This process is rather slow in comparison to other modes of printing. Sublimation dyes have been formulated into toner mixtures used for the higher speed laser, electrostatic and/or electrophotographic printing applications as described in U.S. Pat. No. 6,143,454. Sublimation dyes have also been added to formulations used for the newer ink jet process as described in U.S. Pat. No. 5,830,263. With the ink jet or laser printing applications, the sublimation dye is printed on a temporary receptor which will later be reheated to transfer the image-wise mark to a final receptor. In all these applications, where sublimation dyes are used as the colorants, the process by which the dye colors the final receptor is the same; yet, the printing methods are different.

The receptor for sublimation dyes is a support of many types, such as paper, films or fabrics, that is either composed of or coated with a polymer known as a polyester. The term and polymers referred to as polyesters are well known to those skilled in the art. Polyesters are used as the receptor for sublimation dyes. Many polyesters undergo a secondary phase transition that attract the dyes to enter and become trapped within the molecular framework of the polymer. This secondary phase transition occurs at about the same temperature and pressure as the printing dyes sublimate. A secondary phase transition refers to a reversible change in shape or structure in difference to a primary change of state such as ice melting. As both the colorant and receptor are heated, the polyester changes to an "open" conformation as the dye begins to sublimate and enters the structure. As heat energy is removed, the reverse process occurs and the polymer undergoes a "closed" conformational change locking and trapping the dye within the polymer structure. The overall effect of the dye-polymer interaction is one of becoming attracted, trapped and caged. Many polymers cannot exhibit such a secondary phase transition, and therefore, cannot attract and trap the dye within. One such polymer is natural cotton. Sublimation dyes will neither be attracted to or bind within a fiber of cotton. Therefore, when fabrics are used as the receptor for sublimation printing, such fabrics (like t-shirts or banners), are either 100% polyester or a cotton/high polyester blend fabric containing sufficient polyester in the fabric to allow the sublimation dyes to be attracted and bind to the fabric blend. Untreated cotton makes a poor receptor for sublimation dyes.

SUMMARY OF THE INVENTION

The present invention provides transfer sheets and processes that are especially suitable for use with materials such as cotton (including high cotton content/polyester blends) as a receptor in sublimation printing.

The present invention provides a transfer sheet comprising in the following order (a) a support, (b) a barrier layer capable of releasing a polyester layer in the absence of water, chemicals or heat, (c) a polyester layer capable of being released from said barrier layer in the absence of water, chemicals or heat, and (d) an optional sublimation dye layer, and a method for transferring an image to a receptor element using the transfer sheet. In a preferred embodiment, the polyester layer does not contain thermosetting materials. The invention provides a medium by which heat activated sublimation dyes can penetrate and adhere to a surface not inherently capable of supporting sublimation dyes, for example, 100% cotton fabric or high cotton content/polyester blends (i.e. 50% or more cotton, 60% or more cotton, or 70%, 75%, 80%, or 90% or more cotton). This medium also provides a colorfast and waterfast environment for the printed image, especially during laundering/cleaning.

It should be further noted that although the invention provides for an easy technique for using materials such as cotton as receptors for sublimation printing, the invention is also applicable for use with receptors containing large amounts of polyester or even 100% polyester.

By printing onto a material containing an effective amount of polyester for allowing the sublimation dyes to adhere thereto, peeling the coatings from the support, positioning the peeled coatings to a cotton receptor, optionally placing a non-stick overlay onto the peeled coatings, and applying energy (i.e. heat/pressure), the user is able to utilize sublimation dyes with cotton. In effect, the sublimation dyes bind onto the polyester which adheres onto a high content cotton receptor.

The present invention solves the problem in the art (i.e. sublimation printing onto materials such as cotton) by delivering a material to the receptor element which provides a medium by which heat-activated sublimation dyes can penetrate and adhere to a surface (i.e. cotton) not inherently capable of being imaged with sublimation dyes. In addition, the present invention has the added property of allowing the printer to print the image in the correct rather than the reverse order. In contrast to commercially available papers used for sublimation printing, the present invention is capable of being peeled and placed upon the final receptor with the image in correct order. With prior art papers, the image must be printed in reverse in order to display a correct image order after heating.

A further embodiment of the invention provides a method of applying a sublimation dye image to a receptor element, which comprises the steps of:

(i) imaging a transfer sheet with sublimation dyes, wherein said transfer sheet comprises in the following order:

(a) a support, (b) a barrier layer capable of releasing a polyester layer in the absence of water, chemicals or heat, (wherein the polyester preferably does not comprise thermosetting materials and said barrier layer preferably having essentially no tack at transfer temperatures), (c) a polyester layer capable of being released from said barrier layer in the absence of water, chemicals or heat, (wherein the polyester layer preferably does not contain thermosetting materials), said polyester being optionally imaged with sublimation dyes, and (d) an optional sublimation dye image receiving layer which is present in the case where the polyester is not imaged with sublimation dyes;

(ii) peeling by physically separating in the absence of water, chemicals or heat the imaged polyester layer, or the polyester and the imaged optional sublimation dye receiving layer from the barrier layer, (iii) placing the peeled and imaged polyester layer or the polyester and the imaged optional sublimation dye receiving layer onto a receiving element, wherein the imaged surface is preferably not placed directly against the receiving element (i.e. the image is preferably image side up and facing the observer), (iv) optionally placing a non-stick sheet onto the peeled (i.e. physically separated) imaged polyester layer or onto the polyester and the imaged optional sublimation dye receiving layer, (v) applying heat energy to the optional non-stick sheet or directly to the image bearing side of the receptor element to drive the polyester and sublimation dye image into said receptor element, wherein said sublimation dyes sublimate and penetrate into said polyester layer and adhere to said receptor element without an external adhesive layer; and (vi) removing said optional non-stick sheet, when present, from said receptor element wherein the sublimation dye image-containing polyester layer is embedded in said receptor element.

In another embodiment of the invention, a pre-printed sublimation dye image is transferred to a receptor element by the steps comprising:

(i) providing a pre-printed transfer sheet, which comprises, in the following order:

(a) a support, (b) a barrier layer capable of releasing a polyester layer in the absence of water, chemicals or heat, (wherein the polyester preferably does not comprise thermosetting materials and said barrier layer preferably having essentially no tack at transfer temperatures), (c) a polyester layer capable of being released from said barrier layer in the absence of water, chemicals or heat, (preferably the polyester layer does not contain thermosetting materials), said polyester being optionally pre-printed with sublimation dye, and (d) an optional pre-printed sublimation dye layer, said optional imaged sublimation dye layer being present when said polyester layer does not contain an image, and (ii) peeling by physically separating in the absence of water, chemicals or heat, the imaged polyester layer and optional sublimation dye containing layer from the barrier layer, (iii) placing the peeled and imaged polyester layer and sublimation dye containing layer onto a receiving element, wherein the imaged surface is preferably not placed directly against the receiving element (i.e. the image is preferably image side up and facing the observer), (iv) optionally placing a non-stick sheet onto the peeled (i.e. physically separated) imaged polyester layer and sublimation dye containing layer, (v) applying heat energy to the optional non-stick sheet or directly to the image bearing side of the receptor element to drive the polyester and sublimation dye image into said receptor element, wherein said sublimation dyes sublimate and penetrate into said polyester layer and adhere to said receptor element; and (vi) removing said optional non-stick sheet, when present, from said receptor element, wherein the sublimation dye image-containing polyester layer is embedded in said receptor element.

Alternatively, the present invention is directed to method of applying a sublimation dye image to a receptor element, which comprises the steps of:

(i) imaging a transfer sheet with sublimation dyes, wherein said transfer sheet comprises in the following order:

a support, a barrier layer preferably having essentially no tack at transfer temperatures, and a polyester layer, (preferably provided that the polyester layer does not comprise thermosetting materials), and an optional sublimation dye imaging receiving layer;

(ii) positioning the imaged polyester layer or sublimation dye image receiving layer against said receptor element (i.e. the transfer sheet is then placed on the receptor element, with the polyester layer/optional sublimation dye image receiving layer in contact with the receptor element);

(iii) applying heat energy to the rear surface of the transfer sheet to transfer said sublimation dye image and said polyester layer to said receptor element, wherein said sublimation dyes sublimate and penetrate into said receptor element together with the polyester; and (iv) stripping said transfer sheet away from said receptor element, wherein the sublimation dye image-containing polyester layer is adhered to said receptor element.

In another embodiment of the invention, there is provided a kit comprising either the above-described transfer sheets of the present invention and a receptor element, such as a cotton or cotton/polyester blend fabric and a set of directions (i.e. steps of the above-mentioned transfer methods) for transferring an image from the transfer sheet to a receptor element.

DETAILED DESCRIPTION OF THE INVENTION

The availability of a sublimation dye printable heat transfer sheet would allow consumers to separately purchase the fabric (i.e. receptor or receiving element) and optionally home image the transfer sheet and decorate the fabric at home, without the assistance of professional or commercial printing processes.

In one method of the present invention, an image is formed on a polyester layer or on an optional sublimation dye image receiving layer as follows: a support is coated with a barrier layer described above and preferably having essentially no tack at transfer temperatures and then with a polyester layer plus optional sublimation dye image receiving layer, wherein the barrier layer provides the ability to peel and release the layers located above it (i.e. the polyester layer plus optional sublimation dye image receiving layer). The transfer product is then printed, image-wise, using sublimation dyes by either a consumer at home or is commercially pre-printed prior to purchase by the consumer. The polyester layer may comprise any polyester material which melts within a temperature range of 60° C. to 270° C., flows to a receptor element, and upon cooling adheres to the receptor element thereby providing a medium for the integration of sublimation dye upon heat activation.

The sublimation dye image is physically peeled (i.e. removed) from the transfer sheet along with the polyester coating and optional sublimation dye image receiving layer without the need of water, chemicals or heating. The peeled coating is then placed onto a receptor element preferably with the image facing an observer (i.e. facing "up") and preferably not with the image placed directly against the receptor element. An optional non-stick sheet is placed on top of the peeled coating and heat energy is applied using either a hand iron or heat press. The non-stick sheet is not necessary if the iron surface is non-stick and can be placed directly against the image without adversely affecting the quality of the image. The optional non-stick sheet is stripped away from the transferred image, leaving the image behind on the receptor element.

The non-stick sheet is any non-stick or tack-free sheet in the art including but not limited to a silicone sheet, a sheet coated with a barrier layer according to the present invention, or a substrate or support sheet.

The phrase "having essentially no tack at transfer temperatures" means that the barrier layer does not stick to the polyester layer to an extent sufficient to adversely affect the quality of the transferred image. For the peel-away embodiment, "transfer temperature" ranges from very cold to very hot (i.e. −20 to 59° C.) such that the melt transfer layer/release layer is capable of being peeled at virtually any possible temperature that a user would practically utilize the material. However, this is generally at ambient temperatures, such as 15 to 39° C. In the embodiment where the transfer occurs by applying heat to the rear surface of the support, the "transfer temperature" refers to a typical ironing temperature, such as 60–220° C.

A. The Transfer Sheet

1. Support

Suitable supports include those supports disclosed in Provisional Application U.S. Ser. No. 60/156,593, PCT/US00/29796 (WO 01/23664), U.S. application Ser. No. 09/541,083 filed Mar. 31, 2000 and Ser. No. 09/557,173 filed Apr. 21, 2000, as well as U.S. Pat. Nos. 5,242,739, 5,271,990 and 5,501,902 to Kronzer et al. which are herein incorporated by reference. The support provides the base material for the transfer sheet onto which an image and other layers are applied. Preferably, the support will provide a surface that will promote, or at least not adversely affect, image adhesion and image release. It is preferable that the support material be resistant to damage upon heat application at temperatures less than 275° C. An appropriate support may include but is not limited to a cellulosic nonwoven web or film, such as a smooth surface, heavyweight (approximately 24 lb.) laser printer or color copier paper stock or laser printer transparency (polyester) film. Preferably, the support of the present invention is a sheet of laser copier/printer paper or a polyester film base. However, highly porous supports are less preferred because they tend to absorb large amounts of the barrier coating without providing as much release. Preferably, the support of the present invention is a cellulosic nonwoven web support, a paper support or film support comprising a polyester or polyethylene terephthalate. One example of a commercially available support is a standard sheet of laser copier/printer paper such as Microprint Laser paper from Georgia Pacific.

The particular support used is not known to be critical, so long as the support has sufficient strength for handling, copying, coating, optional heat transfer from the back-side as described in Provisional Application U.S. Ser. No. 60/156,593, PCT/US00/29796 (WO 01/23664), and other operations associated with the present invention.

In one embodiment of the invention, the support can be usable in a laser copier or laser printer. A preferred support for this embodiment is equal to or less than approximately 4.0 mils thick.

Since this particular support is useable in a laser copier or laser printer, antistatic agents may be present. The antistatic agents may be present in the form of a coating on the back surface of the support as an additional layer. The back surface of the support is the surface that is not coated with the release layer, barrier layer, etc.

When the antistatic agent is applied as a coating onto the back surface of the support, the coating will help eliminate copier or printer jamming by preventing the electrostatic adhesion of the paper base to the copier drum of laser and electrostatic copiers and printers. Antistatic agents, or "antistats" are generally, but not necessarily, conductive polymers that promote the flow of charge away from the paper. Antistats can also be "humectants" that modulate the level of moisture in a paper coating that affects the build up of charge. Antistats are commonly charged tallow ammonium compounds and complexes, but also can be complexed organometallics. Antistats may also be charged polymers that have a similar charge polarity as the copier/printer drum; whereby the like charge repulsion helps prevent jamming.

Antistatic agents include, by way of illustration, derivatives of propylene glycol, ethylene oxide-propylene oxide block copolymers, organometallic complexes such as titanium dimethylacrylate oxyacetate, polyoxyethylene oxide-polyoxyproylene oxide copolymers and derivatives of cholic acid.

More specifically, commonly used antistats include those listed in the *Handbook of Paint and Coating Raw Materials*, such as t-Butylaminoethyl methacrylate; Capryl hydroxyethyl imidazoline; Cetethyl morpholinium ethosulfate; Cocoyl hydroxyethyl imidazoline Di(butyl, methyl pyrophosphato)ethylenetitanate di(dioctyl, hydrogen phosphite); Dicyclo(dioctyl)pyrophosphato; titanate; Di(dioctylphosphato)ethylene titanate; Dimethyl diallyl ammonium chloride; Distearyldimonium chloride; N,N'-Ethylene bis-ricinoleamide; Glyceryl mono/dioleate; Glyceryl oleate; Glyceryl stearate; Heptadecenyl hydroxyethyl imidazoline; Hexyl phosphate; N(β-Hydroxyethyl)ricinoleamide; N-(2-Hydroxypropyl)benzenesulfonamide; Isopropyl4-aminobenzenesulfonyl di(dodecylbenzenesulfonyl)titanate; Isopropyl dimethacryl isostearoyl titanate; isopropyltri(dioctylphosphato)titanate; Isopropyl tri(dioctylpyrophosphato)titanate; Isopropyl tri(N ethylaminoethylamino)titanate; (3-Lauramidopropyl)trimethyl ammonium methyl sulfate; Nonyl nonoxynol-15; Oleyl hydroxyethylimidazoline; Palmitic/stearic acid mono/diglycerides; PCA; PEG-36 castor oil; PEG-10 cocamine; PEG-2 laurate; PEG-2; tallowamine; PEG-5 tallowamine; PEG-15 tallowamine; PEG-20 tallowamine; Poloxamer 101; Poloxamer 108; Poloxamer 123; Poloxamer 124; Poloxamer 181; Poloxamer 182; Polaxamer 184; Poloxamer 185; Poloxamer 188; Poloxamer 217; Poloxamer 231; Poloxamer 234; Poloxamer 235; Poloxamer 237; Poloxamer 282; Poloxamer 288; Poloxamer 331; Polaxamer 333; Poloxamer 334; Poloxamer 335; Poloxamer 338; Poloxamer 401; Poloxamer 402; Poloxamer 403; Poloxamer 407; Poloxamine 304; Poloxamine 701; Poloxamine 704; Polaxamine 901; Poloxamine 904; Poloxamine 908; Poloxamine 1107; Poloxamine 1307; Polyamide/epichlorohydrin polymer; Polyglyceryl-10 tetraoleate; Propylene glycol laurate; Propylene glycol myristate; PVM/MA copolymer; polyether; Quaternium-18; Slearamidopropyl dimethyl-β-hydroxyethyl ammonium dihydrogen phosphate; Stearamidopropyl dimethyl-2-hydroxyethyl ammonium nitrate; Sulfated peanut oil; Tetra(2, diallyoxymethyl-1butoxy titanium di(di-tridecyl)phosphite; Tetrahydroxypropyl ethylenediamine; Tetraisopropyl di(dioctylphosphito)titanate; Tetraoctyloxytitanium di(ditridecylphosphite); Titanium di(butyl, octyl pyrophosphate) di(dioctyl, hydrogen phosphite)oxyacetate; Titanium di(cumylphenylate)oxyacetate; Titanium di(dioctylpyrophosphate)oxyacetate; Titanium dimethacrylate oxyacetate.

Preferably, Marklear AFL-23 or Markstat AL-14, polyethers available from Whitco Industries, are used as an antistatic agents.

The antistatic coating may be applied on the back surface of the support by, for example, spreading a solution comprising an antistatic agent (i.e., with a metering rod) onto the back surface of the support and then drying the support. The present invention may use the antistatic coating disclosed in U.S. application Ser. No. 09/541,083 filed Mar. 31, 2000 by Williams et al.

An example of a preferred support of the present invention is Georgia Pacific brand Microprint Laser Paper. However, any commercially available laser copier/printer paper may be used as the support in the present invention.

2. Barrier Layer

Suitable barrier layers include the barrier layers disclosed in U.S. application Ser. No. 09/637,082 filed Aug. 11, 2000, Ser. No. 09/791,755 filed Feb. 26, 2001, Ser. No. 09/541,083 filed Mar. 31, 2000 and Ser. No. 09/557,173 filed Apr. 21, 2000, which are herein incorporated by reference. The barrier layer preferably has essentially no tack at transfer temperatures and is coated on the support and allows for the physical release via peeling of all layers coated above it (i.e. the polyester layer and the optional sublimation dye image receiving layer) without the need for water, chemicals or heat. Only barrier layers which release the layers coated thereon without the need for water, chemicals or heat are included in the peel-away embodiment of the present invention.

In the peel-away embodiment, the barrier layer is preferably as defined in U.S. Ser. No. 09/637,082 and comprises (1) a vinyl acetate with a Tg in the range of −10° C. to 100° C., (2) a thermoplastic polymer having essentially no tack at transfer temperatures, a solubility parameter of at least 10 $(Mpa)^{1/2}$, and a glass transition temperature of at least 0° C., or (3) thermosetting polymers, ultraviolet curing polymers, or combinations thereof.

In one embodiment, the barrier layer comprises polymer dispersion. For example, the polymer dispersion may comprise one or more of the components selected from the group consisting of polyacrylates, styrene-butadiene copolymers, ethylene-vinyl acetate copolymers, nitrile rubbers, poly(vinylchloride), poly(vinylacetate) and ethylene-acrylate copolymers. Preferably, the polymer dispersion comprises polyvinyl acetate dibutyl maleate copolymer.

In another embodiment of the invention where the image is transferred by applying heat to the rear-surface of the transfer material as is conventionally done in the art, the barrier layer has a melting point of at least 65° C. and comprising (i) particles of a thermoplastic polymer having dimensions of about 1 to about 50 micrometers, from about 10 to about 50 weight percent of a film-forming binder, based on the weight of the thermoplastic polymer, and optionally from about 0.2 to about 10 weight percent of a fluid viscosity modifier, based on the weight of the thermoplastic polymer, (ii) about 15 to about 80 percent by weight of a film-forming binder selected from the group consisting of ethylene-acrylic acid copolymers, polyolefins, and waxes and from about 85 to about 20 percent by weight of a powdered thermoplastic polymer selected from the group consisting of polyolefins, polyesters, polyamides, waxes, epoxy polymers, ethylene-acrylic acid copolymers, and ethylene-vinyl acetate copolymers, wherein each of said film-forming binder and said powdered thermoplastic polymer melts in the range of from about 65° C. to about 180 degrees Celsius and the powdered thermoplastic polymer consists of particles of about 1 to about 50 micrometers, (iii) a film forming binder selected from the group consisting of ethylene-acrylic acid copolymers having particles of about 1 to about 50 micrometers, polyolefins, and waxes and which melts in the range of from about 65° C. to about 180 degrees Celsius, (iv) a thermoplastic polymer having particles of about 1 to about 50 micrometers selected from the group consisting of polyolefins, polyesters, and ethylene-vinyl acetate copolymers and which melts in the range of from about 65 to about 180 degrees Celsius or, (v) a thermoplastic polymer having particles of about 1 to about 50 micrometers selected from the group consisting of polyolefins, polyesters, and ethylene-vinyl acetate copolymers, ethylene-methacrylic acid copolymers, and ethylene-acrylic acid copolymers and which melts in the range of from about 65 to about 180 degrees Celsius; wherein said transfer layer is capable of transferring and adhering developed image and non-image areas from said front surface of said support upon the application of heat energy to the rear surface of the support, said transfer layer strips from said front surface of the support by liquefying and releasing from said support when heated, said liquefied transfer layer providing adherence to a receptor element by flowing onto said receptor element and solidifying thereon, said adherence does not require an external surface adhesive layer.

In another embodiment, the barrier layer may comprise a polymer selected from the group consisting of a thermosetting polymer, an ultraviolet curable polymer, and combinations thereof, or the barrier layer may comprise acetone, 2-propanol, and polymethyl methacrylate. The thermosetting polymer is preferably selected from the group consisting of thermosetting acrylic polymers and blends; thermosetting polyurethanes, block polyurethanes and aromatic-functional urethanes; thermosetting polyester polymers and co-polymer systems; aromatic-functional vinyl polymers and polymer blends; and thermosetting epoxy resins.

Materials that fall into the class of thermosetting polymers for use in the barrier layer should provide for room temperature peelability. Thermosetting polymers are both chemically and physically distinct from thermoplastic polymers, which, among other properties, flow upon the addition of heat energy. The fact that the thermosetting material polymerizes to form a layer which cannot be re-melted and flow with heat energy imparts the necessary physical release property. That is, the thermosetting material of the barrier layer of the present invention will not undergo a temperature dependent physical state change which can produce, among other properties, a tack that could provide a physical adherence of the release layer to the support base.

Thermosetting materials include thermosetting acrylic polymers and blends, such as hydroxyl-functional acrylic polymers and carboxy-functional acrylic polymers and vinyl acrylic polymer blends; thermosetting polyurethanes, block polyurethanes and aromatic-functional urethanes; thermosetting polyester polymers and co-polymer systems such as neopentyl glycol isophthalic polyester resins, dibromoneopentyl glycol polyester resins and vinyl ester resins; aromatic-functional vinyl polymers and polymer blends; and thermosetting epoxy resins, in particular, epoxy novolac resins. Generally, the thermosetting polymer system(s) must undergo crosslinking reaction(s) over a range of temperatures from ambient (e.g. 190°) to 250° C. over a period of less than thirty (30) minutes.

Coating weights of the barrier layer may range from one (1) gram per meter square to 20 grams per meter square, preferably from 1 $g/m^2$ to 15 $g/m^2$, most preferably 1 $g/m^2$ to 8 $g/m^2$.

The Barrier Layer also may optionally include an effective amount of a release-enhancing additive for assisting in release of the layer(s) above it (i.e. polyester layer) from the barrier during peeling, such as a divalent metal ion salt of a fatty acid, a polyethylene glycol, or a mixture thereof. The release-enhancing additive may be present in an amount of from 0.1 to 40% by weight, preferably 0.1 to 20% by weight, most preferably 0.1 to 10% by weight.

For example, the release-enhancing additive may be calcium stearate, a polyethylene glycol having a molecular weight of from about 2,000 to about 100,000, or a mixture thereof. For a description of suitable thermosetting polymers, see pages 10 to 13 of *Polymer Chemistry, an Introduction*, Malcolm P. Stevens, 1990; and pages 113 and 299 of *Textbook of Polymer Science*, Fred W. Billmeyer, Jr., 1962.

Preferably, the barrier layer is any vinyl acetate with a Tg in the range of from −10° C. to 100° C. Alternatively, the Tg may be in the range of from 0° C. to 100° C. EVERFLEX G, with a Tg of about −7°, may be used as a preferred embodiment.

Ultraviolet curable/setting materials may be used as the barrier layer of the present invention. UV setting materials can be divided into two classes based upon the mechanism by which they set. The first class of ultraviolet curing/setting materials set via a cationic mechanism while the second class sets via a free radical mechanism. It is important to note, however, that a number of ultraviolet curing systems incorporate both classes into a single formulation, typically termed a hybrid resin system. In one embodiment of the present invention, the ultraviolet curing system, especially when comprising cationic systems, may incorporate thermosetting polymers, thereby resulting in systems that typically are cured initially by ultraviolet activation, then further cured by exposure to a heat source. In such an embodiment, the final coated surface has the best properties of both thermosetting and ultraviolet setting systems. As a consequence of such multiple pathways to create the final cured coating, the ultraviolet setting compounds to be listed herein may be activated by any combination of the mechanisms described herein.

Furthermore, the thermosetting or UV curable barrier layer of the present invention may be combined with at least one vinyl acetate polymer. One of ordinary skill in the art would recognize the appropriate mechanism or mechanisms by which to activate a specific formulation of ultraviolet curing compounds and formulations that include both ultraviolet curing compounds and thermosetting compounds.

Typical formulations of ultraviolet curable systems are composed of primary resins, which provide the major film-forming properties; modifying resins, which modify the film properties to meet specifications for the application in which it is to be used; additives, which provide or enhance specific properties of the film; and photoinitiators which, when exposed to an ultraviolet radiation source, begin the cross-linking reaction that cures the system. The UV curable polymers of the present invention are typically cured at <50 $mJ/cm^2$ with a mercury vapor ultraviolet lamp.

Primary and modifying resins are discussed as a single class as they often cross over from one application to the next. These ultraviolet curable resins include, but are not limited to monomers and oligomers. Monomers such as monofunctional monomers including acrylates, methacrylates, and ethylacrylates; difunctional monomers including various diacrylates and dimethacrylates, especially tripropylene glycol diacrylate, bisphenol A diacrylates and ethoxylated bisphenol A dimethacrylates; trifunctional monomers including various triacrylates and trimethacrylates, especially trimethylolpropane ethoxy triacrylate and trimethyl propane triacrylates; higher functionality monomers including tetra- and pentaacrylates and pentaacrylate esters; aliphatic and aromatic acrylates; aromatic urethane acrylates; metallic acrylates; water dispersible monomers such as, for example, 2(2-ethoxyethoxy) ethylacrylate and polyethylene glycol diacrylates; adhesion promoting monomers such as various acrylate esters and methacrylate esters; pigment dispersing monomers; and scorch retarding monomers.

Oligomers such as aliphatic urethane acrylates; aliphatic urethane diacrylates; aliphatic urethane triacrylates; hexafunctional aliphatic urethane acrylates; hexafunctional aromatic urethane acrylates; trifunctional aromatic urethane acrylates, aromatic urethane acrylates; urethane methacrylates; epoxy acrylates; epoxy methacrylates; polybutadiene dimethylacrylates; diacrylates of bisphenol-A epoxy resins; modified bisphenol-A epoxy acrylate resins; novolac epoxy acrylates; modified epoxy acrylates, partially acrylated bisphenol-A epoxy resins; bisphenol-A epoxy diacrylates; polyester resins including chlorinated polyester resins, modified polyester resins, polyester methacrylates, acrylated polyesters, modified polyester acrylates, modified polyester hexaacrylates, polyestertetracrylates, and hexafunctional polyester acrylates; cycloaliphatic epoxideresins, especially 3,4-epoxycyclohexyl-methyl-3,4,-epoxycyclohexame carboxylate; modified cycloaliphatic epoxides, especially acrylate modified cycloaliphatic epoxides containing both acrylate and epoxy functionalities; aliphatic polyols; partially acrylated bisphenol-A epoxy resins; and cycloaliphatic diepoxides.

Photoinitiators for the ultraviolet curable systems include, but are not limited to alpha hydroxy ketone; benzil dimethyl ketal; benzoin normal butyl ethers; benzophenone; modified benzophenones; polymeric hydroxy ketones; trimethylbenzophenone blends; sulfonium, iodonium, ferrocenium or diazonium salts, especially cyclic 1,2-propylene carbonate bis-p-diphenylsulfoniumphenylsulfide hexafluorophosphate, and diphenylsulfonium hexafluorophosphate; peroxides; cobaloximes and related cobalt (II) complexes; and organic photoinitiators such as, for example, 2,2-diethoxyacetophenone, ethyl 4-(dimethylamino)benzoate, methyldiethanolamine, isopropylthioxanthone, and especially 2-hydroxy-2-methyl-1-phenyl-1-propanone.

Additives that may be used in the above-described ultraviolet curable systems include, but are not limited to photoinitiator activators; slip agents; leveling agents; wetting agents; adhesion promoters; anti-absorption agents; anti-foaming agents, especially mixtures of foam destroying polymers and polysiloxanes; accelerators; pigment dispersion aids; anti-blocking agents; anti-caking agents; anti-slip agents; anti-skinning agents; anti-static agents; anti-stripping agents; binders; curing agents; crosslinking agents; deaerators; diluents; dispersants; dryers; emulsifiers; fillers; flatting agents; flow control agents; gloss agents; hardeners; lubricants; mar resistance aids; whiteners; plasticizers; solvents; stabilizers; surfactants; viscosity modifiers; UV stabilizers; UV absorbers; and water repellants. The barrier layer of the present invention may also comprise the cross-linking polymers of U.S. Pat. No. 5,603,996 to Overcash et al. Specifically, see Overcash et al. at cols. 5–8.

The barrier layer may comprise an acrylic polymer, or resin, as a cross-linkable polymer. Additional cross-linkable acrylic polymers include MICHEM COAT 50A, made by Michelman, Inc., and RHOPLEX.RTM. P-376 and RHOPLEX.RTM. B-15, made by Rohm and Haas. In addition, styrene-butadiene resins, or polymers, ("SBR") are suitable as cross-linkable polymers in the barrier coating composition, including such SBR's as MICHEM COAT 50H, made by Michelman, Inc., and Latex PB 6692NA made by Dow Chemical. Blends and/or copolymers of cross-linkable polymers may also be used. Other cross-linkable polymers, such as polyurethane polymers and various fluorochemical polymers (e.g., 3B ZONYL.RTM. 7040 made by Du Pont), may also provide the necessary barrier properties.

A more specific listing of polymers that may be used as cross-linkable polymers includes, but is not limited to:

polymers and copolymers of poly(dienes) such as poly (butadiene), poly(isoprene), and poly(1-penetenylene);

poly(acrylics) such as poly(benzyl acrylate), poly(butyl acrylate)(s), poly(2-cyanobutyl acrylate), poly(2-ethoxyethyl acrylate), poly(ethyl acrylate), poly(2-ethylhexyl acrylate), poly(fluoromethyl acrylate), poly(5,5,6,6,7,7,7-heptafluoro-3-oxaheptyl acrylate), poly(heptafluoro-2-propyl acrylate), poly(heptyl acrylate), poly(hexyl acrylate), poly (isobornyl acrylate), poly(isopropyl acrylate), poly(3-methoxybutyl acrylate), poly(methyl acrylate), poly(nonyl acrylate), poly(octyl acrylate), poly(propyl acrylate), and poly (p-tolyl acrylate);

poly(acrylamides) such as poly(acrylamide), poly(N-butylacrylamide), poly(N,N-dibutylacrylamide), poly(N-dodecylacrylamide), and poly(morpholylacrylamide);

poly(methacrylic acids) and poly(methacrylic acid esters) such as poly(benzyl methacrylate), poly(octyl methacrylate), poly(butyl methacrylate), poly(2-chloroethyl methacrylate), poly(2-cyanoethyl methacrylate), poly(dodecyl methacrylate), poly(2-ethylhexyl methacrylate), poly(ethyl methacrylate), poly(1,1,1-trifluoro-2-propyl methacrylate), poly(hexyl methacrylate), poly(2-hydroxyethyl methacrylate), poly(2-hydropropyl methacrylate), poly(isopropyl methacrylate), poly(methacrylic acid), poly(methyl methacrylate) in various forms such as, atactic, isotactic, syndiotactic, and heterotactic; and poly(propyl methacrylate);

poly(methacrylamides) such as poly(4-carboxy phenylmethacrylamide);

other alpha-and beta-substituted poly(acrylics) and poly (methacrylics) such as poly(butyl chloracrylate), poly(ethyl ethoxycarbonylmethacrylate), poly(methyl fluoroacrylate), and poly(methyl phenylacrylate);

poly(vinyl ethers) such as poly(butoxyethylene), poly (ethoxyethylene), poly(ethylthioethylene), (dodecafluorobutoxyethylene), poly(2,2,2-trifluoroethoxytrifluoroethylene), poly(hexyloxyethylene), poly(methoxyethylene), and poly (2-methoxypropylene);

poly(vinyl halides) and poly(vinyl nitriles) such as poly (acrylonitrile), poly(1,1-dichloroethylene), poly(chlorotrifluoroethylene), poly(1,1-dichloro-2-fluoroethylene), poly(1,1-difluoroethylene), poly(methacrylonitrile), poly(vinyl chloride), and poly(vinylidene chloride);

poly(vinyl esters) such as poly(vinyl acetate), poly(benzoyloxyethylene), poly(4-butyryloxybenzoyloxyethylene), poly(4-ethylbenzoyloxyethylene), poly[(trifluoroacetoxy) ethylene], poly[(heptafluorobutyryloxy)ethylene], poly (formyloxyethylene), poly[(2-methoxybenzoyloxy)ethylene], poly(pivaloyloxyethylene), and poly (propionyloxyethylene);

poly(styrenes) such as, poly(4-acetylstyrene), poly[3-(4-biphenylyl)styrene], poly(4-[(2-butoxyethoxy) methyl]styrene), poly(4-butoxymethyl styrene), poly(4-butoxystyrene), poly(4-butylstyrene), poly(4-chloro-2-methylstyrene), poly(2-chlorostyrene), poly(2,4-dichlorostyrene), poly(2-ethoxymethyl styrene), poly(4-ethoxystyrene), poly(3-ethylstyrene), poly(4-fluorostyrene), poly(perfluorostyrene), poly(4-hexylstyrene), poly [4-(2-hydroxyethoxymethyl)styrene], poly [4-(1-hydroxy-1-methylpropyl)styrene], poly(2-methoxymethylstyrene), poly(2-methoxystyrene), poly(alpha-methylstyrene), poly(2-methylstyrene), poly(4-methoxystyrene), poly(4-octanoylstyrene), poly(4-phenoxystyrene), poly(4-phenylstyrene), poly(4-propoxystyrene), and poly(styrene);

poly(oxides) such as poly(ethylene oxides), poly(tetrahydrofuran), poly(oxetanes), poly(oxybutadiene), poly[oxychloromethyl)ethylene], poly(oxy-2-hydroxytrimethyleneoxy-1,4-phenylenemethylene-1,4-phenylene), poly(oxy-2,6-dimethoxy-1,4-phenylene), and poly(oxy-1,3-phenylene);

poly(carbonates) such as polycarbonate of Bisphenol A, and poly[oxycarbonyloxy-4,6-dimethyl]-1,2-phenylenemethylene-3,5-dimethyl-1,2-phenylene];

poly(esters) such as poly(ethylene terephthalate), poly[(1,2-diethoxycarbonyl)ethylene], poly[(1,2-dimethoxycarbonyl)ethylene], poly(oxy-2-butenyleneoxysebacoyl), poly[di (oxyethylene)oxyadipoyl], poly(oxyethyleneoxycarbonyl-1,4-cyclohexylenecarbonyl), poly (oxyethyleneoxyisophthaloyl), poly[di(oxyethylene) oxyoxalyl], poly[di(oxyethylene)oxysuccinyl], poly (oxyethyleneoxyterephthaloyl), poly(oxy-1,4-phenyleneisopropylidene-1,4-phenylene oxysebacoyl), and poly(oxy-1,3-phenyleneoxyisophthaloyl);

poly(anhydrides) such as poly(oxycarbonyl-1,4-phenylenemethylene-1,4-phenylenecarbonyl), and poly(oxyisophthaloyl);

poly(urethanes) such as poly(oxycarbonyliminohexamethyleneiminocarbonyloxydecamethylene), poly(oxyethyleneoxycarbonyliminiohexamethyleneiminocarbonyl), poly (oxyethyleneoxycarbonylimino-1,4-phenylenetrimethylene-1,4-phenyleneiminocarbonyl), poly (oxydodecamethyleneoxycarbonyliminodecam ethyleneiminocar bonyl), and poly(oxytetramethyleneoxycarbonylimino-1,4-phenylenemethylene-1,4-phenyleneiminocarbonyl);

poly(siloxanes) such as, poly(dimethylsiloxane), poly [oxy(methyl)phenylsilylene], and poly(oxydiphenylsilylene-1,3-phenylene);

poly(sulfones) and poly(sulfonamides) such as poly[oxycarbonyl di(oxy-1,4-phenylene)sulfonyl-1,4-phenyleneoxy-1,4-phenylene], poly[oxy-1,4-phenylenesulfinyl-1,4-phenyleneoxy-1,4-phenylenecarbonyl-1,4-phenylene), poly (oxy-1,4-phenylenesulfonyl-1,4-phenylene), and poly (sulfonyl-1,3-cyclohexylene);

poly(amides) such as nylon-6, nylon-6,6, nylon-3, nylon-4,6, nylon-5,6, nylon-6,3, nylon-6,2, nylon-6,12, and nylon-12;

poly(imines) such as poly(acetyliminoethylene), and poly (valeryl iminoethylene);

poly(benzimidazoles) such as poly(2,6-benzimidazolediyl-6,2-benzimidazolediyloctamethylene);

carbohydrates such as amylose triacetate, cellulose triacetate, cellulose tridecanoate, ethyl cellulose, and methylcellulose;

and polymer mixtures and copolymers thereof such as poly(acrylonitrile-co-styrene) with poly(e-caprolactone), or poly(ethyl methacrylate), or poly(methyl methacrylate);

poly(acrylonitrile-co-vinylidene chloride) with poly(hexamethylene terephthalate);

poly(allyl alcohol-co-styrene) with poly(butylene adipate), or poly(butylene sebacate); poly(n-amyl methacrylate) with poly(vinyl chloride);

bisphenol A polycarbonate with poly(e-caprolactone), or poly(ethylene adipate), or poly(ethylene terephthalate), or novolac resin;

poly(butadiene) with poly(isoprene);

poly(butadiene-co-styrene) with glycerol ester of hydrogenated rosin;

poly(butyl acrylate) with poly(chlorinated ethylene), or poly(vinyl chloride);

poly(butyl acrylate-co-methyl methacrylate) with poly (vinyl chloride);

poly(butyl methacrylate) with poly(vinyl chloride);

poly(butylene terephthalate) with poly(ethylene terephthalate), or poly(vinyl acetate-co-vinylidene chloride);

poly(e-caprolactone) with poly(chlorostyrene), or poly (vinyl acetate-co-vinylidene chloride);

cellulose acetate with poly(vinylidene chloride-co-styrene);

cellulose acetate-butyrate with poly(ethylene-co-vinyl acetate);

poly(chlorinated ethylene) with poly(methyl methacrylate);

poly(chlorinated vinyl chloride) with poly(n-butyl methacrylate), or poly(ethyl methacrylate), or poly(valerolactone);

poly(chloroprene) with poly(ethylene-co-methyl acrylate);

poly(2,6-dimethyl-1,4-phenylene oxide) with poly(a-methylstyrene-co-styrene styrene), or poly(styrene);

poly(ethyl acrylate) with poly(vinyl chloride-co-vinylidene chloride), or poly(vinyl chloride);

poly(ethyl methacrylate) with poly(vinyl chloride);

poly(ethylene oxide) with poly(methyl methacrylate);

poly(styrene) with poly(vinyl methyl ether); and poly(valerolactone) with poly(vinyl acetate-co-vinylidene chloride).

A suitable barrier layer to be optionally used may be the release layer of U.S. Pat. No. 5,798,179 to Kronzer.

In a preferred embodiment, the barrier layer may be composed of a thermoplastic polymer having essentially no tack at transfer temperatures, a solubility parameter of at least about 19 $(Mpa)^{1/2}$, and a glass transition temperature of at least about 0° C. As used herein, the phrase "having essentially no tack at transfer temperatures" means that the barrier layer does not stick to the polyester layer to an extent sufficient to adversely affect the quality of the transferred image. For the peel-away embodiment, "transfer temperature" ranges from very cold to very hot (i.e. −20 to 59° C.) such that the melt transfer layer/release layer is capable of being peeled at virtually any possible temperature that a user would practically utilize the material. However, this is generally at ambient temperatures, such as 15 to 39° C. In the embodiment where the transfer occurs by applying heat to the rear surface of the support, the "transfer temperature" refers to a typical ironing temperature, such as 60–220° C.

By way of illustration, the thermoplastic polymer may be a hard acrylic polymer or poly(vinyl acetate). For example, the thermoplastic polymer may have a glass transition temperature ($T_g$) of at least about 25° C. As another example, the $T_g$ may be in a range of from about 25° C. to about 100° C. The barrier layer also may include an effective amount of a release-enhancing additive, such as a divalent metal ion salt of a fatty acid, a polyethylene glycol, or a mixture thereof. For example, the release-enhancing additive may be calcium stearate, a polyethylene glycol having a molecular weight of from about 2,000 to about 100,000, or a mixture thereof.

Additionally, there are no primary or secondary changes of state upon heating that would alter the physical characteristics (such as, for example, surface residue) upon transfer. The barrier layer of the present invention preferably transfers no residue to the transferred image. If the transfer product is not used as a peel-away product but is heated from the back side in a conventional manner in order to transfer the image to a receptor element, the barrier layer of the present invention should allow efficient conduction of heat to the polyester layer and sublimation dyes, and under these circumstances the barrier layer preferably provides a water barrier that helps prevent penetration of the support.

In a preferred embodiment of the invention, the barrier layer is a vinyl acetate polymer. In another embodiment of the present invention, the barrier layer contains a polyester resin such as polymethyl methacrylate (PMMA) in a molecular weight range of from 15,000 to 120,000 Daltons.

The barrier layer may possess hot, warm and cold peel properties, such as when EVERFLEX G is used as part of the barrier layer. However, such properties are only necessary if the image is transferred by ironing the back side of the transfer product in a conventional manner. That is, after heat is applied to the transfer sheet and the image is transferred to the receptor, the transfer sheet may be peeled away from the receptor immediately after ironing (hot peel), before it is allowed to cool (i.e., warm peel), or alternatively, the transfer sheet is allowed to cool before it is peeled away from the receptor (i.e., cold peel). Preferably, the barrier provides the ability to physically remove the layers coated therein in the absence of chemicals or heat.

By way of example, the barrier layer may comprise the following polymers which have suitable glass transition temperatures as disclosed in U.S. Pat. No. 5,798,179 to Kronzer:

| Polymer Type | Product Identification |
|---|---|
| Polyacrylates | Hycar ® 26083, 26084, 26120, 26104, 26106, 26322, B.F. Goodrich Company, Cleveland, Ohio<br>Rhoplex ® HA-8, HA-12, NW-1715, Rohm and Haas Company, Philadelphia, Pennsylvania<br>Carboset ® XL-52, B.F. Goodrich Company, Cleveland, Ohio |
| Styrene-butadiene copolymers | Butofan ® 4264, BASF Corporation, Samia, Ontario, Canada<br>DL-219, DL-283, Dow Chemical Company, Midland, Michigan |
| Ethylene-vinyl acetate copolymers | Dur-O-Set ® E-666, E-646, E-669, National Starch & Chemical Co., Bridgewater, New Jersey |
| Nitrile rubbers | Hycar ® 1572, 1577, 1570 × 55, B.F. Goodrich Company, Cleveland, Ohio |
| Poly (vinyl chloride) | Vycar ® 352, B.F. Goodrich Company, Cleveland, Ohio |
| Poly (vinyl Acetate) | Vinac XX-210, Air Products and Chemicals, Inc., Napierville, Illinois |
| Ethylene-acrylate copolymers | Michem ® Prime, 4990, Michelman, Inc., Cincinnati, Ohio<br>Adcote 56220, Morton Thiokol, Inc., Chicago, Illinois |

An additional embodiment of the barrier layer of the present invention is 100 parts (by weight) Polyester Resin (Polylite 32-737; Reichhold, Inc.). The polyester coating is applied with a dry coat weight of from 1 to 20 g/m$^2$, preferably 1–15 g/m$^2$ and most preferably 1–8 g/m$^2$. Coating methods include gravure, metered rod, air knife, cascade, etc. Coatings are cured by exposure to thermal energy that ranges from 30° C. to 250° C., preferably 70° C. to 200° C., and most preferably 120° to 170° C. Curing times range from 10 seconds to 20 minutes, preferably from 1 minute to 18 minutes, most preferably from 8 minutes to 15 minutes.

3. Polyester Layer

Suitable polyester layers include those release layers disclosed in U.S. application Ser. No. 09/541,083 filed Mar.

31, 2000, and Ser. No. 09/557,173 filed Apr. 21, 2000, and the heat sealing layer of Ser. No. 09/547,760 filed Apr. 12, 2000 which are herein incorporated by reference. The polyester layer is formed on the barrier layer and must be capable of being released from said barrier layer in the absence of water, chemicals and heat, and further comprises any polyester material or combination of polyester materials which melts within a temperature range of from about 60° C. to about 270° C., flows to a receptor element, and adheres to the receptor element to provide a medium for integration of sublimation dyes upon heat activation. The polyester layer further serves as a release layer which facilitates the transfer of the image from the support and barrier layers to the receptor. This layer is physically separated (i.e. peeled) from the barrier layer without the need for water, chemical or heat for releasing. Alternatively, if the transfer product is to be used conventionally, that is, if the transfer product is heated from the back side so as to transfer the layers above the barrier layer to the receptor, it must be capable of releasing from the barrier layer and flowing onto the receiver element. In this case, the polyester layer transfers with the image from the support and barrier layers to the desired receptor. Therefore, the polyester layer should provide the properties to effectively transfer the polyester layer and the image from the sublimation dyes, as well as any additional layers thereon. As stated above, this is done by physically removing from the support the polyester layer and layers coated thereon in the absence of water, heat or chemicals, or in a separate embodiment, transfer is effected in a conventional manner by applying heat and/or pressure to the back side of the transfer element. Further, in both embodiments, the polyester layer should also provide for adhesion of the polyester layer and sublimation dye to the receptor without the requirement of a separate surface adhesive layer.

The polyester layer preferably does not contain thermosetting materials, such as thermosetting polymers. Thermosetting polymers are both chemically and physically distinct from thermoplastic polymers, which, among other properties, flow upon the addition of heat energy. The fact that the thermosetting material polymerizes to form a layer which cannot be re-melted and flow with heat energy imparts both a hot and cold peel release property. That is, the thermosetting material will not undergo a temperature dependent physical state change which can produce a tack, among other properties.

Thermosetting materials include thermosetting acrylic polymers and blends, such as hydroxyl-functional acrylic polymers and carboxy-functional acrylic polymers and vinyl acrylic polymer blends; thermosetting polyurethanes, block polyurethanes and aromatic-functional urethanes; thermosetting polyester polymers and co-polymer systems such as neopentyl glycol isophthalic polyester resins, dibromoneopentyl glycol polyester resins and vinyl ester resins; aromatic-functional vinyl polymers and polymer blends; and thermosetting epoxy resins, in particular, epoxy novolac resins. Generally, the thermosetting polymer system(s) must undergo crosslinking reaction(s) over a range of temperatures from ambient (e.g. 190°) to 250° C. over a period of less than thirty (30) minutes.

In one embodiment, the polyester layer comprises a (a) polyester or polyester/copolymer blend or acrylic dispersion, (b) an elastomeric emulsion, (c) a water repellant and (d) a plasticizer, wherein the polyester or polyester/polymer blend melts in the range of about 60° C. to 270° C. In a preferred embodiment, the acrylic dispersion is an ethylene acrylic acid dispersion, the water repellant is a polyurethane dispersion and the plasticizer is a polyethylene glycol. More preferably, the ethylene acrylic acid dispersion melts in the range of from about 65° C. to about 180° C. By way of example, the ethylene acrylic acid dispersion may be present in an amount of from 46 to 90 parts by weight; the elastomeric emulsion may be present in an amount of from 1 to 45 parts by weight; the polyurethane dispersion may present in an amount of from 1 to 7 parts by weight; and the polyethylene glycol may be present in an amount of from 1 to 8 parts by weight.

In one embodiment, the polyester layer has a melting point of at least 65° C. and comprises (i) particles of a thermoplastic polymer having dimensions of about 1 to about 50 micrometers, from about 10 to about 50 weight percent of a film-forming binder, based on the weight of the thermoplastic polymer, and optionally from about 0.2 to about 10 weight percent of a viscosity modifier, based on the weight of the thermoplastic polymer, (ii) about 15 to about 80 percent by weight of a film-forming binder selected from the group consisting of ethylene-acrylic acid copolymers, polyolefins, and waxes and from about 85 to about 20 percent by weight of a powdered thermoplastic polymer selected from the group consisting of polyolefins, polyesters, polyamides, waxes, epoxy polymers, ethylene-acrylic acid copolymers, and ethylene-vinyl acetate copolymers, wherein each of said film-forming binder and said powdered thermoplastic polymer melts in the range of from about 65° C. to about 180 degrees Celsius, (iii) a film forming binder selected from the group consisting of ethylene-acrylic acid copolymers, polyolefins, and waxes and which melts in the range of from about 65° C. to about 180 degrees Celsius, (iv) a thermoplastic polymer selected from the group consisting of polyolefins, polyesters, and ethylene-vinyl acetate copolymers and which melts in the range of from about 65 to about 180 degrees Celsius or, (v) a thermoplastic polymer selected from the group consisting of polyolefins, polyesters, and ethylene-vinyl acetate copolymers, ethylene-methacrylic acid copolymers, and ethylene-acrylic acid copolymers and which melts in the range of from about 65 to about 180 degrees Celsius, wherein said polyester layer when transferred in a conventional manner (i.e. applying heat and/or pressure from the support side of the transfer material) is capable of transferring and adhering developed image and non-image areas from said front surface of said support upon the application of heat energy to the rear surface of the support, said transfer layer strips from said front surface of the support by liquefying and releasing from said support when heated, said liquefied transfer layer providing adherence to a receptor element by flowing onto said receptor element and solidifying thereon, said adherence does not require an external surface adhesive layer and said transfer layer.

The polyester layer can be formulated using any polyester or polyester polymer blends. Preferably, the polyester layer can include polyacrylates, polyacrylic acid, polymethacrylates, polyvinyl acetates, and co-polymer blends of vinyl acetate and ethylene/acrylic acid co-polymers.

The polyester layer is preferably prepared from, for example, a coating composition comprising an acrylic dispersion, an elastomeric emulsion, a plasticizer, and a water repellant. The water repellant may comprise, for example, a polyurethane dispersion for the purpose of providing water resistance for a retention aid. The plasticizer may be, for example, polyethylene glycol. The polyester layer may further contain performance additives, such as polymers which are not esterified. Preferably, these include polyamide, polyimide or polyurethane polymer components.

In the embodiment where the transfer material is to be transferred in a conventional manner rather than being physically peeled from the barrier layer by the user, and without being bound by any theory, upon back surface heating of the support, the polyester layer would undergo a solid to solution phase transition resulting in a transfer to the receptor of the polyester layer and any additional layers upon contact with a receptor. Edge to edge adhesion to the receptor occurs upon cooling of the release layer onto the receptor. Upon cooling, an image receiving layer is transferred onto the receptor by removing the support/barrier layer. If the coatings are still hot upon removal, this is known as a "hot peel" product. If the coatings are at room temperature upon removal, the product is known as a "cold peel" product. If the coatings are at a temperature above room temperature but below the transfer temperature, the product is a "warm peel" product.

The polyester layer of the present invention protects any transferred image, provides mechanical and thermal stability, as well as washability, preferably without losing the flexibility of the textile. The polyester layer should also provide a colorfast image (e.g. washproof) when transferred to the receptor surface. Thus, upon washing the receptor element (e.g. t-shirt), the image should remain intact on the receptor.

Further, the polyester layer satisfies the requirement for compatible components, in that the component dispersions remain in their finely dispersed state after admixture without coagulating or forming clumps or aggregated particles which would adversely affect image quality. Additionally, the polyester layer is preferably non-yellowing.

The polyester layer has a low content of organic solvents, and any small amounts present during the coating process are sufficiently low so as to meet environmental and health requirements. More specifically, the polyester layer preferably has a content of organic solvents of less than 2% by weight of components. More preferably, the release layer has a content of organic solvents of less than 1% by weight of components.

Various additives may be incorporated into the polyester layer or the barrier and/or sublimation dye receiving layers. Retention aids, wetting agents, plasticizers and water repellants are examples. Each will be discussed in turn below.

Retention Aids

An additive may be incorporated for the purpose of aiding in the binding of the applied colorant such as water-based ink jet colorants. Such additives are generally referred to as retention aids, and include polyamides, polyamines, polymer lactams, polymers and copolymers including pyrrolidone and/or imidazole. Retention aids that have been found to bind colorants generally fall into three classes: silicas, latex polymer and polymer retention aids. Silicas and silicates are employed when the colorant is water-based such as ink jet formulations. An example of widely used silicas are the Ludox (DuPont) brands. Polyvinyl alcohol represents as class of polymers that have also been applied to the binding of ink jet dyes. Other polymers used include anionic polymers such as Hercobond 2000 (Hercules). Reten 204LS (Hercules) and Kymene 736 (Hercules) are cationic amine polymer-epichlorohydrin adducts used as retention aids. Latex polymers include, by way of illustration, vinyl polymers and vinyl co-polymer blends such as ethylene-vinyl acetate, styrene-butadiene copolymers, polyacrylate and other polyacrylate-vinyl copolymer blends. The retention aids are present in an amount of from 0.1 to 40% by weight, preferably 0.1 to 20%, more preferably from 0.1 to 10%.

Wetting Agents and Rheology Modifiers

Wetting agents, rheology modifiers and surfactants may also be included in the polyester layer. Such agents may either be nonionic, cationic or anionic. The surfactant selected should be compatible with the class of polymers used in a formulation. For example, anionic polymers require the use of anionic or non-ionic wetting agents or surfactants. Likewise, cationic surfactants are stable in polymer solution containing cationic or non-ionic polymers. Examples of surfactants or wetting agents include, by way of illustration, alkylammonium salts of polycarboxylic acid, salts of unsaturated polyamine amides, derivatives of nonoxynol, derivatives of octoxynols (Triton X-100 and Triton X-114 (Union Carbide), for example), dimethicone copolymers, silicone glycol copolymers, polysiloxane-polyether copolymers, alkyl polyoxy carboxylates, tall oil fatting acids, ethylene oxide-propylene oxide block copolymers and derivatives of polyethylene glycol. The wetting agents are present in an amount of from 0.1 to 40% by weight, preferably 0.1 to 20%, more preferably from 0.1 to 10%.

Viscosity modifiers may also be included. Generally, various molecular weight polyethylene glycols are incorporated to serve this purpose. Polyethylene glycols used generally range in molecular weight from 100 to 500,000 with molecular weights between 200 and 1000 being the most useful in this application.

Plasticizers

Plasticizers may be included in order to soften hard polymer and polymer blend additions. Plasticizers used include, by way of illustration, aromatic derivatives such as di-octyl phthalate, di-decyl phthalate derivatives and tri-2-ethylhexyl trimellitate. Aliphatic plasticizers include derivatives of ethylhexyl adipates and ethylhexyl sebacates. Epoxidized linseed or soya oils may also be incorporated but generally are not used due to yellowing and chemical instability upon heat application. The plasticizers are present in an amount of from 0.1 to 40% by weight, preferably 0.1 to 20%, more preferably from 0.1 to 10%.

Water Repellants

Water repellant aids may also be incorporated into order to improve the wash/wear resistance of the image. Examples of additives include polyurethanes, wax dispersions such as carnauba wax, mineral waxes, montan wax, derivatives of montan wax, petroleum waxes, synthetic waxes such as polyethylene and oxidized polyethylene waxes, hydrocarbon resins, amorphous fluoropolymers and polysiloxane derivatives. The water repellants are present in an amount of from 0.1 to 40% by weight, preferably 0.1 to 20%, more preferably from 0.1 to 10%.

Particularly when the imaging method is a laser printer or copier, the release layer of the present invention preferably excludes wax dispersions derived from, for example, a group including but not limited to natural waxes such as carnauba wax, mineral waxes, montan wax, derivatives of montan wax, petroleum waxes, and synthetic waxes such as polyethylene and oxidized polyethylene waxes. If the imaging method used is a non-laser printer/copier method it is not necessary to preferably exclude waxes from use in the transfer material. However, the amount of waxes that may be present in the transfer material of the invention when intended for use in laser printers or copiers must be sufficiently low as to avoid adverse affects on copier or printer operation. That is, the amount of wax present must not cause melting in the printer or copier.

An example of a suitable polyester formulation is set forth in Example 6. A first component is the acrylic dispersion which is present in a sufficient amount so as to provide adhesion of the polyester layer and image to the receptor element and is preferably present in an amount of from 46 to 90 weight %, more preferably 70 to 90 weight % based on the total composition of the polyester layer.

The elastomeric emulsion provides the elastomeric properties such as mechanical stability, flexibility and stretch ability, and is preferably present in an amount of from 1 to 45 weight %, more preferably 1 to 20 weight % based on the total composition of the polyester layer.

The water repellant provides water resistance and repellency, which enhances the wear resistance and washability of the image on the receptor, and is preferably present in an amount of from 1 to 7 weight %, more preferably 3 to 6 weight % based on the total composition of the polyester layer.

The plasticizer provides plasticity and anti static properties to the transferred image, and is preferably present in an amount of from 1 to 8 weight %, more preferably 2 to 7 weight % based on the total composition of the polyester layer.

Preferably, the acrylic dispersion is an ethylene acrylic acid co-polymer dispersion that is a film-forming binder that provides the "release" or "separation" from the support. The polyester layer of the invention may utilize the film-forming binders of the image-receptive melt-transfer film layer of U.S. Pat. No. 5,242,739, which is herein incorporated by reference.

Thus, the nature of the film-forming binder is not known to be critical. That is, any film-forming binder can be employed so long as it meets the criteria specified herein. As a practical matter, water-dispersible ethylene-acrylic acid copolymers have been found to be especially effective film forming binders.

The term "melts" and variations thereof are used herein only in a qualitative sense and are not meant to refer to any particular test procedure. Reference herein to a melting temperature or range is meant only to indicate an approximate temperature or range at which a polymer or binder melts and flows under the conditions of a melt-transfer process to result in a substantially smooth film.

Manufacturers' published data regarding the melt behavior of polymers or binders correlate with the melting requirements described herein. It should be noted, however, that either a true melting point or a softening point may be given, depending on the nature of the material. For example, materials such as polyolefins and waxes, being composed mainly of linear polymeric molecules, generally melt over a relatively narrow temperature range since they are somewhat crystalline below the melting point.

Melting points, if not provided by the manufacturer, are readily determined by known methods such as differential scanning calorimeter. Many polymers, and especially copolymers, are amorphous because of branching in the polymer chains or the side-chain constituents. These materials begin to soften and flow more gradually as the temperature is increased. It is believed that the ring and ball softening point of such materials, as determined by ATOM E-28, is useful in predicting their behavior. Moreover, the melting points or softening points described are better indicators of performance than the chemical nature of the polymer or binder.

Representative binders (i.e., acrylic dispersions) for release from the support are as follows:

Binder A

Binder A is MICHEM® 58035, supplied by Michelman, Inc., Cincinnati, Ohio. This is a 35 percent solids dispersion of Allied Chemical's AC 580, which is approximately 10 percent acrylic acid and 90 percent ethylene. The polymer reportedly has a softening point of 102° C. And a Brookfield viscosity of 0.65 pas (650 centipoise) at 140° C.

Binder B

This binder is MICHEM® Prime 4983R (Michelman, Inc., Cincinnati, Ohio). The binder is a 25 percent solids dispersion of Primacy® 5983 made by Dow Chemical Company. The polymer contains 20 percent acrylic acid and 80 percent ethylene. The copolymer has a Vicar softening point of 43° C. And a ring and ball softening point of 100° C. The melt index of the copolymer is 500 g/10 minutes (determined in accordance with ATOM D-1238).

Binder C

Binder C is MICHEM® 4990 (Michelman, Inc., Cincinnati, Ohio). The material is 35 percent solids dispersion of Primacy® 5990 made by Dow Chemical Company. Primacy® 5990 is a copolymer of 20 percent acrylic acid and 80 percent ethylene. It is similar to Primacy® 5983 (see Binder B), except that the ring and ball softening point is 93° C. The copolymer has a melt index of 1,300 g/10 minutes and Vicar softening point of 39° C.

Binder D

This binder is MICHEM® 37140, a 40 percent solids dispersion of a Honest-Celeste high density polyethylene. The polymer is reported to have a melting point of 100° C.

Binder E

This binder is MICHEM® 32535 which is an emulsion of Allied Chemical Company's AC-325, a high density polyethylene. The melting point of the polymer is about 138° C. MICHEM® 32535 is supplied by Michelman, Inc., Cincinnati, Ohio.

Binder F

Binder F is MICHEM® 48040, an emulsion of an East man Chemical Company micro crystalline wax having a melting point of 88° C. The supplier is Michelman, Inc., Cincinnati, Ohio.

Binder G

Binder G is MICHEM® 73635M, an emulsion of an oxidized ethylene-based polymer. The melting point of the polymer is about 96° C. The hardness is about 4–6 Shore-D. The material is supplied by Michelman Inc., Cincinnati, Ohio.

The second component of Polyester Layer Formulation 1 of Example 6 is an elastomeric emulsion, preferably a latex, and is compatible with the other components, and formulated to provide durability, mechanical stability, and a degree of softness and conformability to the layers.

Films of this material must have moisture resistance, low tack, durability, flexibility and softness, but with relative toughness and tensile strength. Further, the material should have inherent heat and light stability. The latex can be heat sensitized, and the elastomeric can be self-crosslinking or used with compatible cross-linking agents, or both. The latex should be spray able, or roll stable for continuous rentability on nip rollers.

Elastomeric latexes of the preferred type are produced from the materials and processes set forth in U.S. Pat. Nos. 4,956,434 and 5,143,971, which are herein incorporated by reference. This curable latex is derived from a major amount of acrylate monomers such as $C_4$ to $C_8$ alkyl acrylate, preferably n-butyl acrylate, up to about 20 parts per hundred of total monomers of a monolefinically unsaturated dicarboxylic acid, most preferably isotactic acid, a small amount of crosslinking agent, preferably N-methyl acrylamide, and optionally another monolefinic monomers.

Using a modified semi batch process in which preferably the isotactic acid is fully charged initially to the reactor with the remaining monomers added over time, a latex of unique polymer architecture or morphology is created, leading to the unique rubbery properties of the cured films produced therefrom.

The third ingredient of Polyester Layer Formulation 1 of Example 6 is a water resistant aid such as a polyurethane dispersion which provides a self-crosslinking solvent and emulsifier-free aqueous dispersion of an aliphatic urethane-acrylic hybrid polymer which, alone, produces a clear, crack-free film on drying having very good scratch, abrasion and chemical resistance. This ingredient is also a softener for the acrylic dispersion and plasticizer aid.

Such product may be produced by polymerizing one or more acrylate and other ethylene monomers in the presence of an oligourethane to prepare oligourethane acrylate copolymers. The oligourethane is preferably prepared from dials and diisocyanates, the aliphatic or alicyclic based diisocyanates being preferred, with lesser amounts, if any, of aromatic diisocyanates, to avoid components which contribute to yellowing. Pulverizable monomers, in addition to the usual acrylate and methacrylate esters of aliphatic mono alcohols and styrene, further include monomers with carboxy groups, such as acrylic acid or methacrylic acid, and those with other hydrophobic groups such as the hydroxy alkyl acrylate (hydroxyethyl methacrylate being exemplary). The hydrophobic groups in these monomers render the copolymer product dispersible in water with the aid of a neutralizing agent for the carboxy groups, such as dimethylethanolamine, used in amount to at least partially neutralize the carboxy groups after dispersion in water and vacuum distillation to remove any solvents used to prepare the urethane acrylic hybrid. Further formulations may include the addition of crosslinking components such as amino resins or blocked polyisocyanates. Although pigments and fillers could be added to any of the coating layers, such use to uniformly tint or color the coated paper could be used for special effect, but would not be used where an image is desired in the absence of background coloration. Urethane acrylic hybrid polymers are further described in U.S. Pat. No. 5,708,072, and their description in this application is incorporated by reference.

Self crosslinking acrylic polyurethane hybrid compositions can also be prepared by the processes and materials of U.S. Pat. No. 5,691,425, herein incorporated by reference. These are prepared by producing polyurethane macro monomers containing acid groups and lateral vinyl groups, optionally terminal vinyl groups, and hydroxyl, urethane, thiourethane and/or urea groups. Polymerization of these macro monomers produces acrylic polyurethane hybrids which can be dispersed in water and combined with crosslinking agents for solvent-free coating compositions.

Autocrosslinkable polyurethane-vinyl polymers are discussed in detail in U.S. Pat. No. 5,623,016 and U.S. Pat. No. 5,571,861, and their disclosure of these materials is incorporated by reference. The products usually are polyurethane-acrylic hybrids, but with self-crosslinking functions. These may be carbolic acid containing, neutralized with, e.g. Tertiary imines such as ethanolamine, and form useful adhesives and coatings from aqueous dispersion.

The elastomeric emulsion and polyurethane dispersion are, generally, thermoplastic elastomers. Thermoplastic elastomeric polymers are polymer blends and alloys which have both the properties of thermoplastic polymers, such as having melt flow and flow characteristics, and elastomers, which are typically polymers which cannot melt and flow due to covalent chemical crosslinking (vulcanization). Thermoplastic elastomers are generally synthesized using two or more monomers that are incompatible; for example, styrene and butadiene. By building long runs of polybutadiene with intermittent polystyrene runs, micro domains are established which imparts the elastomeric quality to the polymer system. However, since the micro domains are established through physical crosslinking mechanisms, they can be broken by application of added energy, such as heat from a hand iron, and caused to melt and flow; and therefore, are elastomers with thermoplastic quality.

Thermoplastic elastomers have been incorporated into the present invention in order to provide the image system with elastomeric quality. Two thermoplastic elastomeric systems have been introduced; that is, a polyacrylate terpolymer elastomeric (for example, Hysteric V-29) and an aliphatic urethane acryl hybrid (for example, Dothan VTW 1265). Thermoplastic elastomers can be chosen from a group that includes, for example, ether-ester, olefinic, polyether, polyester and styrene thermoplastic polymer systems. Specific examples include, by way of illustration, thermoplastic elastomers such as polybutadiene, polybutadiene derivatives, polyurethane, polyurethane derivatives, styrene-butadiene, styrene-butadiene-styrene, acrylonitrile-butadiene, acrylonitrile-butadiene-styrene, acrylonitrile-ethylene-styrene, polyacrylates, polychloroprene, ethylene-vinyl acetate and ploy (vinyl chloride). Generally, thermoplastic elastomers can be selected from a group having a glass transition temperature (Tg) ranging from about −50° C. to about 25° C.

The fourth component of Polyester Layer Formulation 1 of Example 6 is a plasticizer such as a polyethylene glycol dispersion which provides mechanical stability, water repellency, and allows for a uniform, crack-free film. Accordingly, a reason to add the polyethylene glycol dispersion is an aid in the coating process. Further, the polyethylene glycol dispersion acts as an softening agent. A preferred fourth component is Carbowax Polyethylene Glycol 400, available from Union Carbide.

An optional fifth ingredient of Polyester Layer Formulation 1 of Example 6 is a surfactant and wetting agent such as polyethylene glycol mono((tetramethylbutyl)phenol) ether.

In another embodiment of the invention, the polyester layer comprises an acrylic binder and a wax emulsion. The polyester layer may further contain a retention aid such as Hercobond 2000®. The retention aid provides water resistance, which enhances the washability of the image on the support. In another embodiment of the invention, the polyester layer described in Polyester Layer Formulation 2 of Example 7 is divided into two separate layers. An example of this embodiment is a layer comprising ethylene acrylic acid that allows release or separation. An elastomeric and polyurethane of the present invention, as well as any additives discussed above, are combined in a second layer that provides the above-described transfer qualities (i.e., washability).

An additional embodiment of the present invention is a transfer sheet comprising, as the polyester layer, the third layer of U.S. Pat. No. 5,798,179 to Kronzer (US '179). That is, the polyester layer may comprise a thermoplastic polymer which melts in a range of from about 65° C. to about 180° C. And has a solubility parameter less than about 19 $(Mpa)^{1/2}$.

The third layer in U.S. '179 functions as a transfer coating to improve the adhesion of subsequent layers in order to prevent premature delamination of the heat transfer material. The layer may be formed by applying a coating of a film-forming binder over the second layer. The binder may include a powdered thermoplastic polymer, in which case the third layer will include from about 15 to about 80 percent by weight of a film-forming binder and from about 85 to about 20 percent by weight of the powdered thermoplastic polymer. In general, each of the film-forming binder and the powdered thermoplastic polymer will melt in a range from about 65° C. To about 180° C. For example, each of the film-forming binder and powdered thermoplastic polymer may melt in a range from about 80° C. To about 120° C. In addition, the powdered thermoplastic polymer will consist of particles which are from about 2 to about 50 micrometers in diameter.

Polyester Layer Formulation 1 of Example 6 is a preferred embodiment of the invention. In another embodiment of the invention (Polyester Layer Formulation 2), the polyester layer comprises an acrylic binder and a wax emulsion. The polyester layer may further contain a retention aid such as Hercobond 2000°. The retention aid provides water resistance, which enhances the washability of the image on the receptor.

In another embodiment of the invention, the release layer of U.S. application Ser. No. 09/541,083 filed Mar. 31, 2000 to Williams et al. May be used in the present invention.

In another embodiment of the invention, the above-described polyester layer is divided into two separate layers. An example of this embodiment is a layer comprising ethylene acrylic acid that allows release or separation. An elastomeric and polyurethane of the present invention, as well as any additives discussed above, are combined in a second layer that provides the above-described transfer qualities (i.e., washability).

Preferably, the polyester layer is applied by using gravure, cascade, metered rod, fountain or air knife coating methods.

4. Sublimation Dyes and Optional Sublimation Dye Image Receiving Layer

Any sublimation dyes well known in the art may be used including those disclosed in U.S. Pat. Nos. 5,919,609, 5,919,610, 5,888,253, 5,698,364, 5,910,812 and 5,863,860, which are herein incorporated by reference.

The image-wise marking using sublimation dyes can be achieved using any conventional mechanism by which color images (e.g. inks or dyes) are applied to a substrate. For example, the marking can be either from electronic reproduction devices, such as electrostatic printers including but not limited to laser printers or laser copiers (color or monochromatic) wherein the sublimation ink pigments are granules dispersed in a carrier, ink-jet printers wherein the sublimation dyes are dispersed in a solvent, sublimation dye printers and the like, or the imaging can be accomplished through conventional printing processes, such as sheet fed offset, web offset, gravure, flexographic or screen printing.

Generally, sublimation dyes are made from a class of dyes known as Acid, Vat, Pigment, disperse, Direct and Reactive Dyes. Typically, Disperse and Direct Dyes are commonly found in sublimation formulations. These dyes are derived from the chemical class of organic systems known as azo anthroquinone and phthalocyanine dye systems. Preferred sublimation dyes are a four to eight color sublimation ink sets. Further, the present invention may be practiced using craft-type marking agents comprising sublimation dyes, such as, for example, markers crayons, paints or pens. A preferred sublimation dye receiving layer is approximately 0.1 to 3.5 mils thick, preferably 0.5 to 3.0 mils.

Image Receiving Layers (IRLs) per se are known in the art. One of ordinary skill in the art would know how to optimize IRLs in order to retain sublimation dyes. The coat weight can be very thin, for instance, about the same coat weight as the barrier layer. There are at least two possible optional image receiving layers, that is, optional sublimation dye receiving layers. In one embodiment, the GIRL is capable of melting. In a second embodiment, the GIRL is not capable of melting.

The Image Receiving Layer (GIRL) of the present invention should be able to retain an image such as an image dye. However, when the polyester is not capable of retaining a dye, the GIRL of the invention is required. In one embodiment, upon the application of heat, the polyester and the optional GIRL become heat activated (e.g. melt) to trap or encapsulate the dye image or ink and optionally impart waterfast characteristics.

The GIRL comprises binders, such as polyvinyl alcohol (PVOH), various colorant retention aids, and an antioxidant. An antioxidant is added to keep the polyvinyl alcohol (PVOH) from discoloring (yellowing) during the heat process. A suitable PVOH is described in Example 2 of U.S. Application Ser. No. 09/547,760.

Other polyvinyl alcohols may be used which are considered to be of fully hydrolyzed (98.0–98.8% hydrolysis) or preferably super hydrolyzed grade (99.3+% hydrolysis). In addition to polyvinyl alcohol, suitable binders for the GIRL include crystalline polymers such as polyesters, polyamides, polyurethanes, polyether, vinyl polymer and copolymer blends, and polymer and copolymer blends which form ordered close packed film structures. Examples include, but are not limited to ploy(methyl vinyl ether), ploy(vinyl chloride), ploy(styrene), ploy(ethylene adipate), ploy(hexamethylene adipate), ploy(acetate), ploy(ethylene terephthalate), ploy(methyl methacrylate), ploy(acrylic acid), ploy acrylate and ploy(vinyl butyral).

Suitable antioxidants include, but are not limited to, BAH; Bias(2,4-di-t-butylene)pentaerythritol diphosphite; 4,4'-Butylenebis(6-t-butyl-m-cress), C20–40 alcohols; p-Cress/dicyclopentadiene butyl reaction product, Di(butyl, methylpyrophosphato)ethylene titanate di(dioctyl, hydrogen phosphate); Dicyclo(dioctyl)pyrophosphato titanate; Di(dioctylphosphato)ethylene titanate; Di (dioctylpyrophosphato)ethylene titanate; Dibutyl nonyl phenol; Dimethylaminomethyl phenol, Ethylhydroxymethyloleyl oxazoline Isopropyl 4aminobenzenesulfonyl di(dodecylbenzenesulfonyl)titanate; Isopropyldimethacrylisoslearoyl titanate; Isopropyl(dioctylphosphato)titanate; isopropyltridioctylpyrophosphato) titanate; Isopropyl tri(N ethylamino-ethylamino) titanate, Lead phthalate, basic 2,2-Methylenebis(6-t-butyl-4-methylphenol), Octadecyl 3,5-di-t-butyl-4-hydroxyhydrocinnamate Phosphorus; Phosphorus trichloride, reaction prods. With 1,1'-biphenyl and 2,4-bis (1,1-dimethyl ethyl)phenol Tetra(2, diallyoxymethyl-1butoxy titanium di(di-tridecyl)phosphate; Tetraisopropyl di(dioctylphosphito)titanate; Tetrakis[methylene(3,5-di-t-butyl-4-hydroxyhydrocinnamate)]methane; Tetraoctyloxytitanium; di(ditridecylphosphite); 4,4'-Throbs6-(t-butyl-m-cress); Titanium di(butyl, octyl pyrophosphato)di(diocLyl, hydrogen phosphate)oxyacetate; Titanium di(cumylphenylate)oxyacetate; Titanium di(dioctylpyrophosphate), oxyacetate; Titanium dimethyacrylate oxyacetate; 2,2,4-Tri methyl-1,2-dihydroquinoline polymer; Tries(nonylphenyl)phosphate.

Preferably, the antioxidant used is octadecyl 3,5-Di-tart-butyl-4-hydroxyhydrocinnamate. An aqueous solution of a cationic amine polymer-epichlorohydrin adducts acts as the dye retention aid. An additional binder is included in order to impart colorant retention and mechanical stability. A list of applicable binders include, but are not limited to, those listed in U.S. Pat. No. 5,798,179, in addition to polyolefins, polyesters, ethylene-vinyl acetate copolymers, ethylene-methacrylate acid copolymers, and ethylene-acrylic acid copolymers. Suitable coating weight is in the range of 1–50 $g/m^2$ (dry), preferably in the range of 1–30 $g/m^2$ (dry), and more preferably in the range of 1–10 $g/m^2$ (dry).

Chemically, the GIRL corresponds to virtually all known image receiving layers in the art of transfer images to, for example, t-shirts. However, in one embodiment the image receiving layer either does not melt when heat is applied or melts at a temperature above the melting temperature of the polyester layer. In this embodiment, the image receiving layer does not melt below 260° C.

The image receiving layer functions as a retention aid for the image. Accordingly, the image receiving layer should preferably be optimized for sublimation dye that is being applied in accordance with the knowledge of one of ordinary skill in the art. For example, the image layer could contain polyethylene wax (Allied Signal, Acumist A-12).

The optional image receiving layer may be an acrylic coating upon which an image is applied. The image receiving layer may comprise a film-forming binder selected from the group comprising of ethylene-acrylic acid copolymers, polyolefins, and waxes.

In another embodiment, the image receiving layer may utilize the materials of the fourth layer of U.S. Pat. No. 5,798,179. Thus, the image receiving layer may comprise particles of a thermoplastic polymer having largest dimensions of less than about 50 micrometers. Preferably, the particles will have largest dimensions of less than about 50 micrometers. More preferably, the particles will have largest dimensions of less than about 20 micrometers. In general, the thermoplastic polymer may be any thermoplastic polymer which meets the criteria set forth herein. Desirably, the powdered thermoplastic polymer will be selected from the group consisting of polyolefins, polyesters, polyamides, and ethylene-vinyl acetate copolymers.

The Image Receiving Layer also includes from about 10 to about 50 weight percent of a film-forming binder, based on the weight of the thermoplastic polymer. Desirably, the amount of binder will be from about 10 to about 30 weight percent. In general, any film-forming binder may be employed which meets the criteria set forth herein. When the Image Receiving Layer includes a cationic polymer as described below, a nonionic or cationic dispersion or solution may be employed as the binder. Suitable binders include polyacrylates, polyethylenes, and ethylene-vinyl acetate copolymers. The latter are particularly desired because of their stability in the presence of cationic polymers. The binder desirably will be heat soften able at temperatures of about 120° C. or lower.

The Image Receiving Layer typically will have a melting point of from about 65° C. To about 180° C. Moreover, the image receiving layer may contain from about 2 to about 20 weight percent of a cationic polymer, based on the weight of the thermoplastic polymer. The cationic polymer may be, for example, an aside-epichlorohydrin polymer, polyacrylamides with cationic functional groups, polyethylene imines, polydiallylamines, and the like. When a cationic polymer is present, a compatible binder should be selected, such as a nonionic or cationic dispersion or solution. As is well known in the paper coating art, many commercially available binders have anodically charged particles or polymer molecules. These materials are generally not compatible with the cationic polymer which may be used in the Image Receiving Layer.

One or more other components may be used in the Image Receiving Layer. For example, this layer may contain from about 1 to about 20 weight percent of a humectant, based on the weight of the thermoplastic polymer. Desirably, the humectant will be selected from the group consisting of ethylene glycol and ploy(ethylene glycol). The ploy(ethylene glycol) typically will have a weight-average molecular weight of from about 100 to about 40,000. A ploy(ethylene glycol) having a weight-average molecular weight of from about 200 to about 800 is particularly useful.

The Image Receiving Layer also may contain from about 0.2 to about 10 weight percent of an ink viscosity modifier, based on the weight of the thermoplastic polymer. The viscosity modifier desirably will be a ploy(ethylene glycol) having a weight-average molecular weight of from about 100,000 to about 2,000,000. The ploy(ethylene glycol) desirably will have a weight-average molecular weight of from about 100,000 to about 600,000.

Other components which may be present in the Image Receiving Layer include from about 0.1 to about 5 weight percent of a weak acid and from about 0.5 to about 5 weight percent of a surfactant, both based on the weight of the thermoplastic polymer. A particularly useful weak acid is citric acid. The term "weak acid" is used herein to mean an acid having a dissociation constant less than one (or a negative log of the dissociation constant greater than 1).

The surfactant may be an anionic, a nonionic, or a cationic surfactant. When a cationic polymer is present in the Image Receiving Layer, the surfactant should not be an anionic surfactant. Desirably, the surfactant will be a nonionic or cationic surfactant. However, in the absence of the cationic polymer, an anionic surfactant may be used, if desired. Examples of anionic surfactants include, among others, linear and branched-chain sodium alkylbenzenesulfonates, linear and branched-chain alkyl sulfates, and linear and branched-chain alkyl epoxy sulfates. Cationic surfactants include, by way of illustration, tallow trimethylammonium chloride. Examples of nonionic surfactants, include, again by way of illustration only, alkyl polyethylenes, polyethoxylated alkylphenols, fatty acid ethanol abides, complex polymers of ethylene oxide, propylene oxide, and alcohols, and polysiloxane polyether. More desirably, the surfactant will be a nonionic surfactant.

The image receiving layer may contain the addition of filler agents with the purpose of modulating the surface characteristics. The surface roughness and coefficient of friction may need to be modulated depending on such factors as desired surface gloss and the imaging device's specific paper feeding requirements. The filler can be selected from a group of polymers such as, for example, polyacrylates, polyacrylics, polyethylene, polyethylene acrylic copolymers and polyethylene acrylate copolymers, vinyl acetate copolymers and polyvinyl polymer blends that have various particle dimensions and shapes. Typical particle sizes may range from 0.1 to 500 microns. Preferably, the particle sizes range from 5 to 100 microns. More preferably, the particle sizes range from 5 to 30 microns. The filler may also be selected from a group of polymers such as, for example, cellulose, hydroxy cellulose, starch and dextran. Silicas and mica may also be selected as a filler. The filler is homogeneously dispersed in the image layer in concentrations ranging from 0.1 to 50%. Preferably, the filler concentration range is 1 to 10 percent.

The image receiving layer becomes heat activated to trap ink and impart wash characteristics. A preferred embodiment of the image receiving layer comprises a PVOH solution, an amine polymer, a thermoplastic polymer, a thermoplastic elastomeric, and an antioxidant.

As stated above, an antioxidant is preferably added to keep the PVOH from discoloring or yellowing upon application of heat. The amine polymer acts as the dye retention/binder. Both thermoplastic chemicals allow the layer to fuse, thus trapping all inks onto the layer and imparting a water resistance upon heating. The elastomeric property is helpful in giving the layer flexibility and useful stretch characteristics so the final product does not tear or crack as easily.

The antioxidant powder is added to a specified amount of PVOH solution and heated to approximately 60° C. And allowed to mix at medium speed for approximately 30 minutes. Upon incorporation of the antioxidant to the PVOH solution, the solution cools to room temperature, followed by incorporation of the remaining chemicals in the presence of a medium stir rate provided by a stir bar. Preferably, upon coating the image receiving layer will have a thickness of about 1.0 mil (wet).

Other suitable IRLs include the image receiving layer according to copending application Ser. No. 09/672,827, filed Sep. 29, 2000 may be used. This copending application is herein incorporated by reference.

The Image Receiving Layer may comprise a film-forming binder selected from the group comprising of ethylene-acrylic acid copolymers, polyolefins, and waxes. A preferred binder is an ethylene acrylic acid co-polymer dispersion. Such a dispersion is represented by Image Receiving Layer Formulation 1:

Image Receiving Layer Formulation 1

| Components | Parts |
|---|---|
| Ethylene Acrylic Acid Co-polymers Dispersion (Michem Prime 4983R, Michelman). | 100 parts |

Below is another Image Receiving Layer formulation that further contains a filler agent:

Image Receiving Layer Formulation 2

| Compound | Parts |
|---|---|
| Ethylene Acrylic Copolymer Dispersion (Michem 4983R, Michelman) | 90 to 99 |
| Ethylene Vinyl Acetate Copolymer Powder (Microthene FE-532-00, Equistar Chemical) | 10 to 1 |

An additional Image Receiving Layer formulation that further contains a filler agent is as follows:

Image Receiving Layer Formulation 3

| Compound | Parts |
|---|---|
| Ethylene Acrylic Copolymer Dispersion (Michem 4983R, Michelman) | 90 to 99 |
| Oxidized polyethylene homopolymer (ACumist A-12, Allied Signal Chemical) | 10 to 1 |

By way of illustration, the Image Receiving Layer may optionally comprise the following formulation compositions:

| Formulation | Description |
|---|---|
| A | 100 parts Orgasol 3501 EXDNAT 1 (a 10-micrometer average particle size, porous, copolymer of nylon 6 and nylon 12 precursors), 25 parts Michem Prime 4983, 5 parts Triton X100 and 1 part Methocel A-15 (methyl cellulose). The coating weight is 3.5 lb. per 1300 square feet. |
| B | Like A, but with 5 parts of Tamol 731 per 100 partsOrgasol 3501, and the Metholcel A-15 is omitted. |
| C | Like a Reichold 97-635 coat (a modified poly(vinyl acetate)), but containing 50 parts of Tone 0201 (a low molecular weight polycaprolactone) per 100 parts Orgasol 3501. |
| D | 100 parts Orgasol 3501, 5 parts Tamol 731, 25 parts Michel Prime 4983 and 20 parts PEG 20 M. |
| E | 100 parts Orgasol 3501, 5 parts Tamol 731, 25 parts Michel Prime 4983 and 5 parts PEG 20 M (a polyethylene glycol having a molecular weight of 20,000). |
| F | 100 parts Orgasol 3501, 5 parts Tamol 731, 25 parts Michem Prime 4983 and 20 parts PEG 20 M (an ehtylene glycol oligomer having a molecular weight of 200). |
| G | 100 parts Orgasol 3501, 5 parts Tamol 731 and 25 parts Sancor 12676 (Sancor 12676 is a heat sealable polyurethane). |

The various layers of the present invention are formed by known coating techniques, such as by curtain coating, Meyer rod, roll, blade, air knife, cascade and gravure coating procedures.

B. Receptor Element

The receptor or receiving element receives the transferred image. A suitable receptor includes but is not limited to textiles including 100% cotton fabric, and high cotton blend fabric, such as a cotton/polyester blend fabric blends (i.e. 50% or more cotton, 60% or more cotton, 70% or more cotton, 75% or more cotton, 80% or more cotton, or 90% or more cotton). The receptor element may also include glass, canvas, metal, wool, plastic, ceramic or any other suitable receptor. Preferably the receptor element is a tee shirt or the like.

The image, as defined herein, may be applied in any desired manner, and is preferably applied using offset printing if the transfer material is to be sold to the end user (i.e. Consumer) as a "pre-print".

To transfer the image, a support layer coated with a barrier layer and then a polyester layer and optionally with the sublimation dye image receiving layer is imaged by using sublimation dyes, the polyester layer and the layers coated thereon are peeled (i.e. physically separated) by the user from the support/barrier without water, chemicals or heat/pressure, the peeled (i.e. Separated) imaged polyester layer or the polyester and the imaged optional sublimation dye receiving layer is placed onto a receiving element, wherein the imaged surface is preferably not placed directly against the receiving element (i.e. the image side is preferably facing up rather than being directly placed against the receiver sheet), a non-stick sheet is optionally but preferably placed onto the peeled (i.e. Separated) imaged polyester layer or the polyester and the imaged optional sublimation dye receiving layer, heat energy is applied to an optional non-stick sheet to drive the polyester and sublimation dye image into said receptor element, wherein said sublimation dyes sublimate and penetrate into said polyester layer adhered to said receptor element; and the optional non-stick sheet is removed from said receptor element. The non-stick sheet is required if the iron adversely affects the image when applied directly thereto.

Alternatively, the present invention is directed to method of applying a sublimation dye image to a receptor element, which comprises, in the following order, the steps of:

(i) imaging a transfer sheet with sublimation dyes, wherein said transfer sheet comprises:

a support, a barrier layer preferably having essentially no tack at transfer temperatures, and a polyester layer, (preferably provided that the polyester layer does not comprise thermosetting materials), and an optional sublimation dye imaging receiving layer;

(ii) positioning the imaged polyester layer or sublimation dye image receiving layer against said receptor element (i.e. the transfer sheet is then placed on the receptor element, with the polyester layer/optional sublimation dye image receiving layer in contact with the receptor element);

(iii) applying heat energy to the rear surface of the transfer sheet to transfer said sublimation dye image and said polyester layer to said receptor element, wherein said sublimation dyes sublimate and penetrate into said receptor element together with the polyester; and (IV) stripping said transfer sheet away from said receptor element, wherein the sublimation dye image-containing polyester layer is adhered to said receptor element.

The heat energy in any embodiment can be applied using a heating device (i.e., a hand iron or heat press). The temperature range of the hand iron is generally in the range of 110 to 220° C. With about 190° C. Being the preferred temperature. The heat press operates at a temperature range of 100 to 220° C. With about 190° C. Being the preferred temperature. In the peel-away embodiment, the heating device is placed over the image side preferably via a non-stick sheet or in the rear side heat application embodiment the heating device is placed on the non-image side of the transfer sheet and moved, for instance, in a circular motion (hand iron only). Pressure (i.e., typical pressure applied during ironing) must be applied as the heating device is moved over non-stick sheet or over the rear side of the transfer sheet. After about two minutes to five minutes (with about three minutes being preferred) using a hand iron or 10 seconds to 50 seconds using a heat press (with about twenty seconds being preferred) of heat and pressure, the heating device is removed. The non-stick sheet/receptor element or the transfer sheet/receptor element is optionally allowed to cool from one to five minutes. The non-stick sheet or the support and barrier layer are then removed from the image which is embedded in the polyester layer which is adhered to the receptor. The above times are with respect to an 8.5×11 inch sheet. The times are proportionately longer or shorter based on the diagonal length of the image media. Preferred methods of iron on transfer are set forth in copending U.S. Application Ser. No. 09/453,881 filed Feb. 14, 2000 to Claudia Barry.

The following examples are provided for a further understanding of the invention, however, the invention is not to be construed as limited thereto.

The following table can be used as a guide to determine optimum coating weights and thickness of the Barrier, Polyester and Image Layers:

Coat Weights and Thickness

| | Parts | Wet Coat ($g/m^2$) | Dry Coat ($g/m^2$) | Thickness (mil) |
|---|---|---|---|---|
| Barrier Layer | 50 | 28 | 2 to 20 | 0.05 to 0.80 |
| Release Layer | 95 | 96.2 | 12 to 50 | 0.48 to 2.00 |
| Image Layer | 100 | 20 | 2 to 25 | 0.1 to 3.5 |

In a preferred embodiment of the invention, the barrier layer is a vinyl acetate polymer. An example of this embodiment is Barrier Layer Formulation 1:

Barrier Layer Formulation 1

| Components | Parts |
|---|---|
| Polyvinyl acetate-dibutyl maleate co-polymer dispersion (such as EVERFLEX G, Hampshire Chemical Corporation) | 50 parts |
| Water | 50 parts |

Barrier Layer Formulation 1 may be prepared as follows: fifty parts of a vinyl acetate-dibutyl male ate polymer dispersion are combined with fifty parts of water by gentle stirring. The stirring is continued for approximately ten minutes at a moderate stir rate (up to but not exceeding a rate where cavitation occurs.). The amount of water added may vary. The only limitation is that sufficient water is added to make the dispersion coatable on the support.

EXAMPLE 2

In another embodiment of the present invention, the barrier layer contains a polyester resin such as polymethyl methacrylate (PUMA) in a molecular weight range of from 15,000 to 120,000 Daltons. An example of the PMAA-containing barrier layer is Barrier Layer Formulation 2:

Barrier Layer Formulation 2

| Components | Parts |
|---|---|
| Acetone 99.5% | 40 parts (weight) |
| 2-Propanol 99.5% | 40 parts (weight) |
| PMMA | 20 parts (weight) |

Barrier Layer Formulation 2 may be prepared as follows: The acetone and 2-proposal are weighed and mixed, and the mixture is stirred. One half of the PUMA is added to the mixture while the mixture is heated to about 25° C. And stirring continues until the PUMA is dispersed. At this point, stirring continues until the remainder of the PUMA is added to the mixture and is dispersed. The mixture is then allowed to cool to room temperature.

EXAMPLE 3

Another example of the barrier layer of the present invention is Barrier Layer Formulation 3:

| Compound | Chemical Class | General (parts by mass) | Preferably (parts by mass) | Most Preferably (parts by mass) |
|---|---|---|---|---|
| Uvacure 1500[a] | Cycloaliphatic epoxide | 10.0–60.0 | 20.0–50.0 | 30.0–40.0 |
| Uvacure 1562[b] | Cycloalipahtic epoxy resin | 40.0–0.0 | 30.0–10.0 | 25.0–15.0 |
| DEN 431[c] | Epoxy novolac resin | 5.0–30.0 | 10.0–20.0 | 12.0–18.0 |
| 2-propanol | Alcohol | 44.4–0.0 | 38.3–12.4 | 30.8–21.7 |
| Uvacure 1590[a] | activated epoxy | 0.5–7.0 | 1.5–6.0 | 2.0–4.0 |
| Ebecryl BPO[a] | aryl ketone | 0.1–1.0 | 0.2–0.6 | 0.2–0.5 |
| BYK 354[c] | Polyacrylate | 0.0–1.0 | 0.0–0.5 | 0.0–0.4 |
| BYK 088[c] | Polysiloxane | 0.0–1.0 | 0.0–0.5 | 0.0–0.4 |

[a]UCB Chemical Corporation - Radcure Business Unit
[b]Dow Chemicals
[c]BYK Chemie Barrier Layer Formulation 3 is prepared as follows: DEN 431, an extremely viscous material, is placed into a beaker first, followed by 2-proposal. The remaining compounds are added in the order in which they appear listed in the table. Manual agitation may be required especially because of the extreme viscosity of DEN 431. Once mechanical agitation is used, the mixture is stirred for about 30–60 minutes at a rate just below the point where cavitation would have occurred.

EXAMPLE 4

A barrier layer comprising Barrier Layer Formulation 3 is cured as follows: a thin film of barrier layer formulation 1, in the range of 1.0 g/m$^2$ to 20 g/m$^2$, is applied to a support and cured at <50 MA/cm$^2$ with a mercury vapor ultraviolet lamp.

EXAMPLE 5

Example 4 is repeated, and after UV curing, the film is further cured at temperatures between 60° C. And 200° in a heat chamber for 1 to 45 minutes.

EXAMPLE 6

In one embodiment of the invention, the polyester layer comprises an ethylene acrylic acid co-polymer dispersion, an elastomeric emulsion, and a polyurethane dispersion. An example of this embodiment is Polyester Layer Formulation 1:

Polyester Layer Formulation 1

| Components | Parts by weight |
|---|---|
| Ethylene Acrylic Acid Co-polymer Dispersion (Michem Prime 4983R, Michelman) | 86 parts |
| Elastomeric emulsion (Hystretch V-29, BFGoodrich) | 5 parts |
| Polyurethane dispersion (Daotan VTW 1265, Vianova Resins) | 4 parts |
| Polyethylene Glycol (Carbowax Polyethylene Glycol 400, Union Carbide) | 4 parts |
| Polyethylene Glycol Mono ((Tetramethylbutyl) Phenol) Ether (Triton X-100, Union Carbide) | 1 part |

Polyester Layer Formulation 1 may be prepared as follows: five parts of the elastomeric dispersion are combined with eighty-six parts of an ethylene acrylic acid co-polymers dispersion by gentle stirring to avoid cavitation. Four parts of a polyurethane dispersion are then added to the mixture. Immediately following the addition of a polyurethane dispersion, four parts of a polyethylene glycol and one part of an nonionic surfactant (e.g., Triton X-100) are added. The entire mixture is allowed to stir for approximately fifteen minutes at a moderate stir rate (up to but not exceeding a rate where cavitation occurs). Once thoroughly combined, the mixture is filtered (for example, through a 53 μm nylon mesh).

EXAMPLE 7

Another embodiment may be found in Polyester Layer Formulation 2:

Polyester layer Formulation 2

| Components | Parts by weight |
|---|---|
| Ethylene Acrylic Acid Co-polymers dispersion (Michem Prime 4938R, Michelman) | 74 parts |
| Wax Dispersion (Michelman 73635M, Michelman) | 25 parts |
| Retention Aid (Hercobond 2000, Hercules) | 1 part |

Alternatively, the binders suitable for Polyester Layer Formulation 1 may be used in lieu of the above-described ethylene acrylic acid copolymer dispersion.

Formulation 2 may be prepared in the following manner: the ethylene acrylic acid co-polymer dispersion and the wax dispersion are stirred (for example in a beaker with a stirring bar). The retention aid is added, and the stirring continues until the retention aid is completely dispersed.

EXAMPLE 8

Offset Printed Sublimation Dye Transfer

Two 8½×11 inch sheets are made and imaged as follows:

A paper support is coated with a barrier layer of Barrier Layer Formulation 1. The paper support and barrier layer are then coated with the polyester layer of Polyester Layer Formulation 1. The polyester layer is coated using gravure coating methods. The coated support is then printed, image-wise, using a sublimation dye four to eight color ink set. A four color sublimation dye set is preferred.

Transfer Method No. 1:

The sublimation dye image is physically peeled (i.e. removed) by the user from the transfer sheet along with the polyester coating without the need of water, chemicals or heating. The peeled coating is then placed onto a 100% cotton fabric, preferably image side facing up and away from the receptor element. A silicon non-stick sheet is placed on top of the peeled coating and heat energy is applied through the non-stick sheet to the receptor element using either a hand iron or heat press at a temperature of about 190° C. Usual pressure applied when ironing is applied as the heating device is moved over the non-stick sheet. After about 180 seconds (15 seconds if using the heat press) of heat and pressure, the transfer device is removed. The non-stick sheet is then peeled away from the receptor. The non-stick sheet is not required if the iron is capable of applied directly to the imaged polyester layer with adversely affecting the resulting transferred image on the receptor element. The non-stick sheet is stripped away from the transferred image, leaving behind the image and polyester layer on the receptor element.

Transfer Method No. 2:

The image is transferred to 100% cotton fabric through the application of heat energy using either a hand iron or heat press on the rear surface of the support. The transferred image is allowed to cool. The paper support and barrier layer are stripped away from the transferred image.

EXAMPLE 9

Two 8½×11 inch sheets are made and imaged as follows:

A film support is coated with a barrier layer of Barrier Layer Formulation 2. The film support and barrier layer are then coated with the polyester layer of Polyester Layer Formulation 2. The polyester layer is coated using cascade coating methods. The polyester layer of the coated support is then printed using screen printing.

Transfer Method No. 1:

The sublimation dye image is physically peeled (i.e. Removed) by the user from the transfer sheet along with the polyester coating without the need of chemicals or heating. The peeled coating is then placed onto a 100% cotton fabric, preferably image side facing up and away from the receptor element. A silicon non-stick sheet is placed on top of the peeled coating and heat energy is applied through the non-stick sheet to the receptor element using either a hand iron or heat press. The non-stick sheet is stripped away from the transferred image, leaving the image behind the image and polyester layer on the receptor element.

Transfer Method No. 2:

The image is transferred to 100% cotton fabric through the application of heat energy using either a hand iron or heat press on the rear surface of the support. The transferred image is allowed to cool to a warm temperature. The film support and barrier layer are stripped away from the transferred image.

EXAMPLE 10

A film support is coated with a barrier layer of Barrier Layer Formulation 3. The film support and barrier layer are then coated with the polyester layer of Polyester Layer Formulation 2. The polyester layer is coated using cascade coating methods. The polyester layer of the coated support is then printed using screen printing. Once printed, the image is transferred to 100% cotton fabric with either Transfer Method 1 or 2 of Example 8.

EXAMPLE 11

A film support is coated with a barrier layer of Barrier Layer which is a 1 gsm–15 gsm coating of 100% Evcote PAR-25™ (EvCo Co.) Which is a PET polymer (polyethylene phthalate polymer derivative) and is thermosetting. The film support and barrier layer are then coated with the polyester layer of Polyester Layer Formulation 2. The polyester layer is coated using cascade coating methods. The polyester layer of the coated support is then printed using screen printing. Once printed, the image is transferred to 100% cotton fabric with either Transfer Method 1 or 2 of Example 8.

EXAMPLE 12

A paper support is coated with a barrier layer of Barrier Layer Formulation 1. The paper support and barrier layer are then coated with the polyester layer of Polyester Layer Formulation 1. The polyester layer is coated using gravure coating methods. The polyester layer of the coated support is then printed, image-wise, using a sublimation dye set of: Disperse Black (Bafixan Black; BAS); Disperse Blue (Bafixan Blue; BAS); Disperse Yellow (Bafixan Yellow; BAS); Disperse Red (Bafixan Red; BAS). Once printed, the image is transferred to 100% cotton fabric with either Transfer Method 1 or 2 of Example 8.

EXAMPLE 13

A paper support is coated with a barrier layer of Barrier Layer Formulation 1. The paper support and barrier layer are then coated with the polyester layer of Polyester Layer Formulation 1. The polyester layer is coated using gravure coating methods. The coated support is then printed, image-wise, using a sublimation dye Offset set of medium energy inks: Dye HT Sublime Cyan, Magenta and Yellow Inks from Superior Ink, Inc. Once printed, the image is transferred to 100% cotton fabric with either Transfer Method 1 or 2 of Example 8.

All cited patents, publications, copending applications, and provisional applications referred to in this application are herein incorporated by reference.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

We claim:

1. A method of applying a sublimation dye image to a receptor element, which comprises the steps of:

(i) imaging a transfer sheet with sublimation dyes, wherein said transfer sheet comprises, in the following order:

(a) a support, (b) a barrier layer capable of releasing a polyester layer in the absence of water, chemicals or heat, (c) a polyester layer capable of being released from said barrier layer in the absence of water, chemicals or heat, said polyester being optionally imaged with sublimation dyes, and (d) an optional sublimation dye receiving layer which is present in the case where the polyester is not imaged with sublimation dyes, and;

(ii) peeling by physically separating in the absence of water, chemicals or heat the imaged polyester layer, or the polyester and the imaged optional sublimation dye receiving layer from the barrier layer, (iii) placing the peeled and imaged polyester layer or the polyester and the imaged optional sublimation dye receiving layer onto a receiving element, (iv) optionally placing a non-stick sheet onto the peeled imaged polyester layer or onto the polyester and the imaged optional sublimation dye receiving layer, (v) applying heat energy to the optional non-stick sheet or directly to the image bearing side of the receptor element to drive the polyester and sublimation dye image into said receptor element, wherein said sublimation dyes sublimate and penetrate into said polyester layer and adhere to said receptor element without an external adhesive layer;

and removing said optional non-stick sheet, when present, from said receptor element wherein the sublimation dye image-containing polyester layer is embedded in said receptor element.

2. The method of claim 1, wherein said imaging is provided by ink jet, offset, gravure, flexographic, laser, ribbon or screen printing.

3. The method of claim 1, wherein said support is selected from the group consisting of a paper support, a film support and cellulosic nonwoven webs.

4. The method of claim 3, wherein said film support comprises a polyester.

5. The method of claim 1, wherein said sublimation dyes are a four to eight color sublimation dye set.

6. The method of claim 1, wherein the polyester layer is applied by using gravure, cascade, metered rod, fountain or air knife coating methods.

7. The method of claim 1, wherein the heat energy is applied using a hand iron or a heat press.

8. The method of claim 1, wherein the receptor element is 100% cotton fabric or a cotton/polyester blend fabric.

9. The method of claim 1, wherein the receptor element is selected from the group consisting of fabric, ceramic, glass, wood, plastic and metal surfaces.

10. The method of claim 1, wherein the barrier layer comprises a polymer dispersion.

11. The method of claim 10, wherein the polymer dispersion comprises one or more of the components selected from the group consisting of polyacrylates, styrene-butadiene copolymers, ethylene-vinyl acetate copolymers, nitrile rubbers, ploy(vinylchloride), ploy(vinylacetate) and ethylene-acrylate copolymers.

12. The method of claim 11, wherein the polymer dispersion comprises polyvinyl acetate dibutyl male ate copolymer.

13. The method of claim 1, wherein said polyester layer comprises a (a) polyester or polyester/copolymer blend, (b) an elastomeric emulsion, (c) a water repellant and (d) a plasticizer, wherein the polyester or polyester/polymer blend melts in the range of about 60° C. to 270° C.

14. The method of claim 13, wherein said polyester or polyester/polymer blend is selected from the group consisting of polyacrylates, polyacrylic acid, polymethacrylates, polyvinyl acetates, copolymer blends of vinyl acetate and ethylene/acrylic acid copolymers.

15. The method of claim 13, wherein the polyester layer further comprises performance additives.

16. The method of claim 13, wherein said water repellant is a polyurethane dispersion and said plasticizer is polyethylene glycol.

17. The method of claim 1, wherein the polyester does not comprise thermosetting materials.

18. A method of transferring an sublimation dye image to a receptor element comprising:

(i) imaging a transfer sheet with sublimation dyes, wherein the transfer sheet comprises, in the following order:

(a) a support, (b) a barrier layer capable of releasing a polyester layer in the absence of water, chemicals or heat, (c) a polyester layer, and (d) an optional sublimation dye imaging receiving layer, and;

(ii) positioning the imaged polyester layer or sublimation dye image receiving layer against said receptor element;

(iii) applying heat energy to the rear surface of the transfer sheet to transfer said sublimation dye image and said polyester layer to said receptor element, wherein said sublimation dyes sublimate and penetrate into said receptor element together with the polyester; and (iv) stripping said transfer sheet away from said receptor element, wherein the sublimation dye image-containing polyester layer is adhered to said receptor element.

19. The method of claim 18, wherein the polyester does not comprise thermosetting materials.

20. A method for transferring a pre-printed sublimation dye image to a receptor element by the steps comprising:

(i) providing a pre-printed transfer sheet, which comprises, in the following order:

(a) a support, (b) a barrier layer capable of releasing a polyester layer in the absence of water, chemicals or heat, (c) a polyester layer capable of being released from said barrier layer in the absence of water, chemicals or heat, said polyester being optionally pre-printed with sublimation dye, and (d) an optional pre-printed dye sublimation layer, said optional imaged sublimation dye layer being present when said polyester layer does not contain an image, and;

(ii) peeling by physically separating in the absence of water, chemicals or heat, the imaged polyester layer and optional sublimation dye containing layer from the barrier layer, (iii) placing the peeled and imaged polyester layer and sublimation dye containing layer onto a receiving element, (iv) optionally placing a non-stick sheet onto the peeled imaged polyester layer and sublimation dye containing layer, (v) applying heat energy to the optional non-stick sheet or directly to the image bearing side of the receptor element to drive the polyester and sublimation dye image into said receptor element, wherein said sublimation dyes sublimate and penetrate into said polyester layer and adhere to said receptor element; and (vi) removing said optional non-stick sheet, when present, from said receptor element, wherein the sublimation dye image-containing polyester layer is adhered to said receptor element.

21. The method of claim 20, wherein the polyester does not comprise thermosetting materials.

* * * * *